US005238188A

United States Patent [19]

Lerner et al.

[11] Patent Number: 5,238,188

[45] Date of Patent: Aug. 24, 1993

[54] SPRINKLER

[75] Inventors: Michael Lerner, Beit Shemesh; Moshe Gorney, Kibbutz Naan, both of Israel

[73] Assignee: Naan Irrigation Systems, Kibbutz Naan, Israel

[21] Appl. No.: 738,165

[22] Filed: Jul. 30, 1991

[30] Foreign Application Priority Data

Aug. 6, 1990 [IL] Israel ..... 95299

[51] Int. Cl.[5] ..... B05B 3/04

[52] U.S. Cl. ..... 239/230; 239/233; 239/DIG. 1

[58] Field of Search ..... 239/230, 231, 232, 233, 239/DIG. 1

[56] References Cited

U.S. PATENT DOCUMENTS 2,345,030 3/1944 Buckner .
2,582,158 1/1952 Porter .
2,610,089 9/1952 Unger .
2,625,411 1/1953 Unger .
2,654,635 10/1953 Lazzarini .
2,816,798 12/1957 Royer .
2,853,342 9/1958 Kachergis .
2,895,681 8/1959 Kachergis .
3,017,123 1/1962 Rinkewich et al. .
3,019,992 2/1962 Zecchinato .
3,022,012 2/1962 Sharp et al. .
3,033,469 5/1962 Green ..... 239/230
3,082,958 3/1963 Thomas .
3,091,399 5/1963 Kennedy .
3,309,025 3/1967 Malcolm .
3,391,868 7/1968 Cooney .
3,434,665 3/1969 Royer .
3,468,485 9/1969 Sully .
3,559,887 2/1971 Meyer .
3,581,994 6/1971 Heiberger ..... 239/230
3,625,429 9/1971 Turell .
3,746,259 7/1973 Apri .
3,765,608 10/1973 Lockwood .
3,837,576 9/1974 Rosenkranz ..... 239/230
3,841,563 10/1974 Lockwood ..... 239/230
3,918,642 11/1975 Best .
3,918,643 11/1975 Malcolm .
3,955,762 5/1976 Cassimatis et al. .
3,977,610 8/1976 Royer .
3,986,671 10/1976 Nuget .
4,055,304 10/1977 Munson .
4,161,286 7/1979 Beamer et al. .
4,164,324 8/1979 Bruninga .
4,177,944 11/1979 Wichman .
4,182,494 1/1980 Witchman et al. .
4,234,126 11/1980 Morgan .
4,330,087 5/1982 Wood et al. .
4,402,460 9/1983 Shavit et al. .
4,453,673 6/1984 Icenbice .
4,497,441 2/1985 Chow ..... 239/230
4,498,626 2/1985 Pitchford .
4,514,291 4/1985 McGarry et al. .
4,537,356 8/1985 Lawson .
4,540,125 9/1985 Gorney et al. .
4,565,323 1/1986 Berkan ..... 239/230
4,580,724 4/1986 Brown et al. .
4,625,913 12/1986 Christen .
4,632,312 12/1986 Premo et al. .
4,760,959 8/1988 Gorney .
4,907,742 3/1990 Whitehead et al. .
4,978,070 12/1990 Chow ..... 239/231
5,031,833 7/1991 Alkalay et al. .

FOREIGN PATENT DOCUMENTS 2138705A 10/1984 United Kingdom .

*Primary Examiner*—Andres Kashnikow
*Assistant Examiner*—Christopher G. Trainor
*Attorney, Agent, or Firm*—Ladas & Parry

[57] ABSTRACT

An impact drive sprinkler including a body defining a nozzle arranged to provide a stream of pressurized liquid; spring loaded stream deflector and hammer apparatus for intermittently engaging the stream and providing in response to the engagement a force causing intermittent rotation of the body about a rotation axis; and apparatus for selectably limiting the amplitude of motion of the deflector and hammer apparatus and thus determining the direction of rotation of the body and the overall range of the resulting spray. The selectably limiting apparatus has first and second orientations corresponding to rotation of the sprinkler in respective forward and return directions and comprises a first hammer engagement surface that is engaged when the sprinkler is rotating in the forward direction. The first hammer engagement surface is arranged such that hammer engagement therewith retains the apparatus for selectably limiting in the first orientation.

20 Claims, 23 Drawing Sheets

SPRINKLER

FIELD OF THE INVENTION

The present invention relates to irrigation sprinklers of the impact drive type.

BACKGROUND OF THE INVENTION

Rotary sprinklers of the impact type are well known in the art and in the patent literature. Exemplary sprinklers of this type are described and claimed in U.S. Pat. Nos. 4,402,460 and 4,760,959, which are assigned to the assignee of the present application, and in U.S. Pat. No. 4,632,312.

Impact drive sprinklers often include apparatus for selectably limiting the azimuth of sprinkler coverage and cooperating apparatus for changing the mode of operation and direction of rotation of the sprinkler at the selected azimuthal boundaries. Normally such apparatus comprises multiple parts, including a spring, and usually must be assembled by hand.

SUMMARY OF THE INVENTION

The present invention seeks to provide an improved impact type sprinkler that is more readily assembled by automatic machinery and techniques.

There is thus provided in accordance with a preferred embodiment of the present invention an impact drive sprinkler including a body defining a nozzle arranged to provide a stream of pressurized liquid, spring loaded stream deflector and hammer apparatus for intermittently engaging the stream and providing in response to the engagement a force causing intermittent rotation of the body about a rotation axis, and apparatus for selectably limiting the amplitude of motion of the deflector and hammer apparatus and thus determining the direction of rotation of the body and the overall range of the resulting spray, the selectably limiting apparatus having first and second orientations corresponding to rotation of the sprinkler in respective forward and return directions, the apparatus for selectably limiting the amplitude of motion including a first hammer engagement surface that is engaged when the sprinkler is rotating in the forward direction, the first hammer engagement surface being arranged such that hammer engagement therewith retains the apparatus for selectably limiting in the first orientation.

Further in accordance with a preferred embodiment of the present invention, the apparatus for selectably limiting the motion also includes a second hammer engagement surface that is engaged when the sprinkler is rotating in the return direction, the second hammer engagement surface being arranged such that the hammer engagement therewith retains the apparatus for selectably limiting in the second orientation.

Additionally in accordance with a preferred embodiment of the present invention, the apparatus for selectably limiting the motion also includes a third hammer engagement surface which may be engaged when the sprinkler is rotating in the forward direction, the third hammer engagement surface being arranged such that the hammer engagement therewith urges the apparatus for selectably limiting towards the first orientation.

In accordance with a preferred embodiment of the invention the apparatus for selectably limiting the amplitude of motion does not include a spring and is formed as a single piece.

In accordance with a preferred embodiment of the present invention, the first hammer engagement surface is arranged such that hammer engagement therewith urges the apparatus for selectably limiting to said first orientation.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
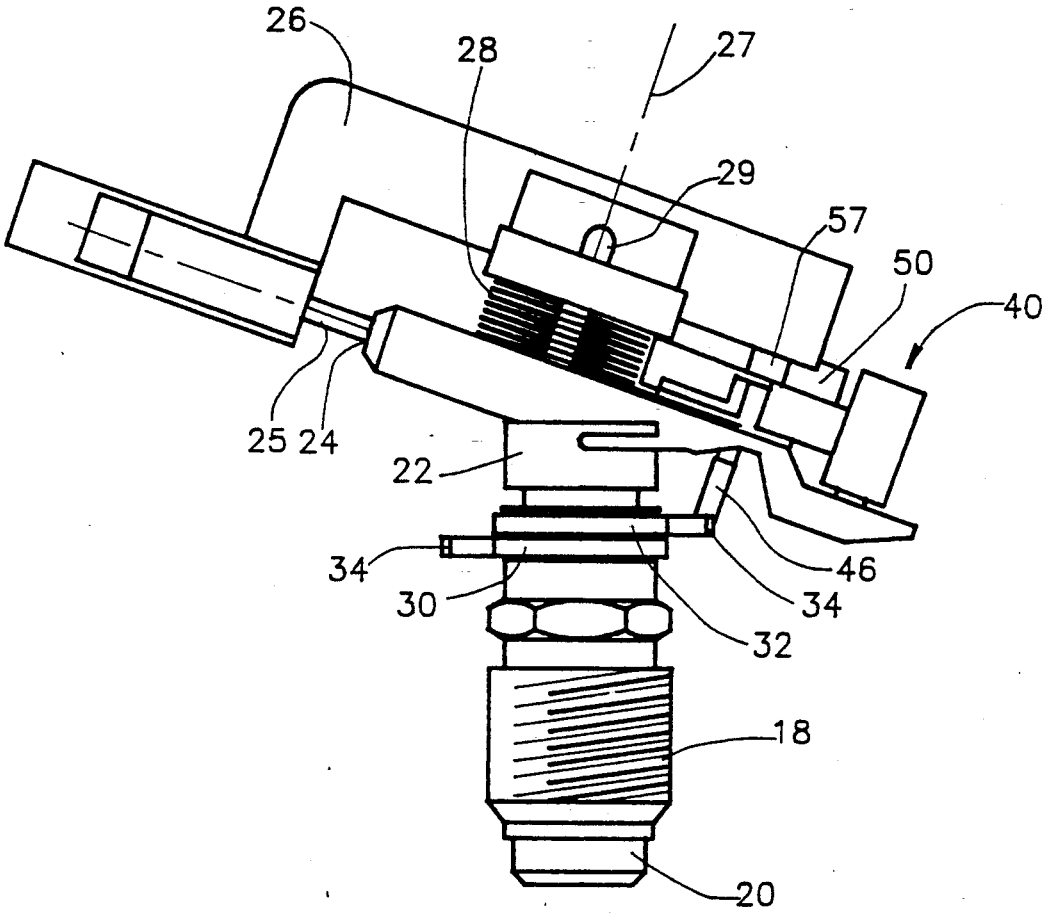
FIG. 1 is a side view illustration of a sprinkler constructed and operative in accordance with a first preferred embodiment of the invention.
Figure 2:
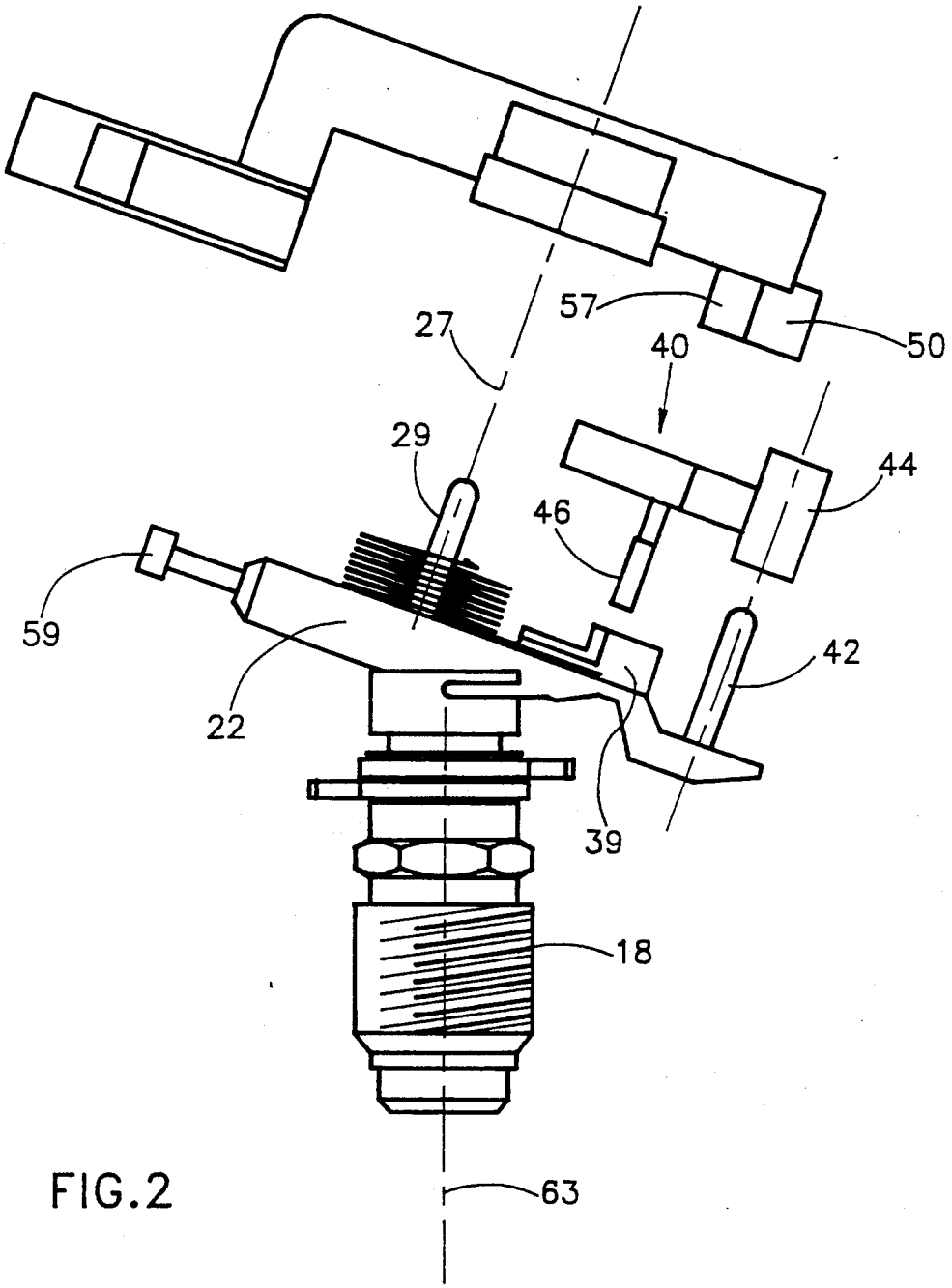
FIG. 2 is a side view illustration in exploded form of the sprinkler of FIG. 1.

Reference is now made to FIGS. 1 and 2, which illustrate a rotary sprinkler constructed and operative in accordance with a preferred embodiment of the present invention. The rotary sprinkler includes a mounting and liquid coupling shaft 18 that is rotatably mounted and sealingly seated onto a liquid supply stem 20.

Mounted onto stem 20 and preferably integrally formed therewith is a body 22, which defines a nozzle outlet 24 for provision of a pressurized stream of liquid, which is directed generally along a nozzle outlet axis 25. A combination liquid stream deflector and hammer element 26 is rotatably mounted onto body 22 and is spring coupled thereto by a spring 28.

Figure 3B:
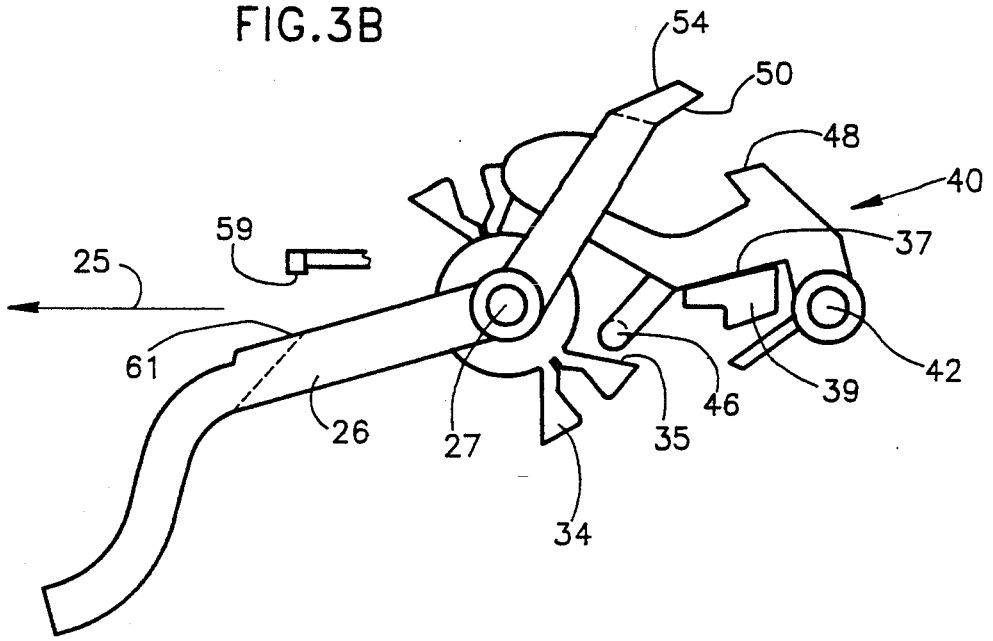
FIGS. 3A and 3B are generalized top view illustrations of the sprinkler of FIGS. 1 and 2 when operating in a forward direction in respective hammer engagement and non-hammer engagement orientations.
Figure 3A:
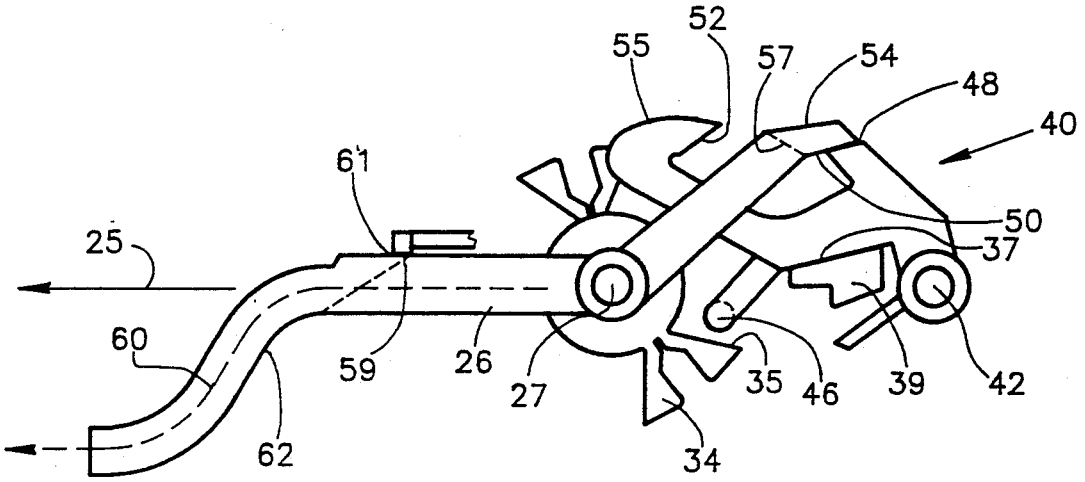

Generally speaking, the action of the deflector and hammer element 26 is intermittently to engage the pressurized stream of liquid for deflection thereof. This causes the deflector to move out of engagement with the stream momentarily, storing potential energy in the spring 28. Spring 28 then exerts a return force that, together with the force produced by engagement of the stream with part of the deflector, causes element 26 to impact against the body, causing its rotation in intermittent steps. What has been described so far is forward motion of the sprinkler, which normally occurs in a clockwise direction when viewed from the top of the sprinkler as shown in FIGS. 3A and 3B.

The sprinkler illustrated in FIGS. 1 and 2 is constructed to provide operation in selectable azimuthal zones. The zones of operation are defined typically by a pair of concentric rings 30 and 32, each formed with protruding end finger portions 34. Rings 30 and 32 are formed with toothed inner peripheral surfaces that selectably engage toothed surfaces (not shown) formed on the shaft 18 so that rings 30 and 32 can be located as desired and retain their location until the location is changed by a user.

The sprinkler of FIGS. 1 and 2 is arranged for forward and backward motion. It is shifted from forward to backward motion by operation of apparatus 40 for selectably limiting the amplitude of motion of the deflector and hammer element 26 and thus determining the direction of rotation of the body.

In accordance with a preferred embodiment of the invention the selectably limiting apparatus 40 has first and second operative orientations corresponding to rotation of the sprinkler in respective forward and return directions. The first operative orientation is illustrated generally in FIGS. 3A and 3B, while the second operative orientation is illustrated generally in FIGS. 4A and 4B.

Apparatus 40 is pivotably mounted onto body 22, typically by means of an upstanding pin 42 integrally formed on body 22, which is engaged by a corresponding collar portion 44, forming part of apparatus 40.

Apparatus 40 is preferably integrally formed as one piece and includes, in addition to collar portion 44, a depending finger portion 46 that serves to engage protruding end finger portions 34 of azimuthal zone selection rings 30 and 32.

Apparatus 40 also defines first hammer engagement surface 48 which is normally engaged by a corresponding hammer striking surface 50 of deflector and hammer element 26 when the sprinkler is rotating in the forward direction. Apparatus 40 also preferably defines a second hammer engagement surface 52, which is engaged by a corresponding hammer striking surface 54 of element 26 when the sprinkler is rotating in the reverse direction.

Additionally in accordance with a preferred embodiment of the present invention, the apparatus for selectably limiting 40 also includes a third hammer engagement surface 55 that may be engaged by a surface 57 of the deflector and hammer element 26 or by surface 50 when the sprinkler is rotating in the forward direction, the third hammer engagement surface 55 being arranged such that the hammer engagement therewith urges the apparatus for selectably limiting 40 toward the first orientation.

According to a preferred embodiment of the invention, the body 22 defines a fourth hammer engagement surface 59 which normally is engaged by a striking surface 61 of the deflector and hammer element 26 during forward motion of the sprinkler. It will be appreciated that when surfaces 59 and 61 engage during forward motion, touching engagement of surfaces 48 and 50 may be eliminated. It is preferred, however, that surfaces 48 and 50 be arranged so that they touch or nearly touch during forward motion, in order to maintain the apparatus 40 in the first orientation. It is preferred that the impact providing forward rotation of the sprinkler body in a clockwise direction be provided by engagement of surfaces 59 and 61.

It is noted that the first hammer engagement surface 48 is configured, located and oriented with respect to the body 22 and with respect to the rotation axis of apparatus 40 defined by pin 42 so that the hammer engagement with surface 48 usually urges the apparatus 40 toward the first orientation and retains the apparatus 40 in the first orientation during multiple hammer engagements producing rotation of the body 22 clockwise about axis 63 and until engagement of depending finger 46 with end finger portions 34 changes the orientation of apparatus 40.

This feature obviates the need, present in the prior art, for the apparatus for selectably limiting the amplitude of motion to include a spring.

Referring specifically to FIGS. 3A and 3B which illustrate forward motion of the sprinkler, it is noted that when apparatus 40 is in its first orientation the counterclockwise motion of the hammer and deflector element 26 is not limited by apparatus 40, thereby providing a relatively large amplitude by hammer motion in a counterclockwise direction, as seen in FIGS. 3A and 3B in response to deflection by the stream of liquid.

This large amplitude motion produces relatively full loading of spring 28 and thus provides, with the assistance of the force produced by engagement of the liquid stream along axis 25 with a part of the deflector, clockwise stepped motion of the body 20 preferably in response to engagement of the hammer striking surface 61 with engagement surface 59 of body 22.

Figure 4A:
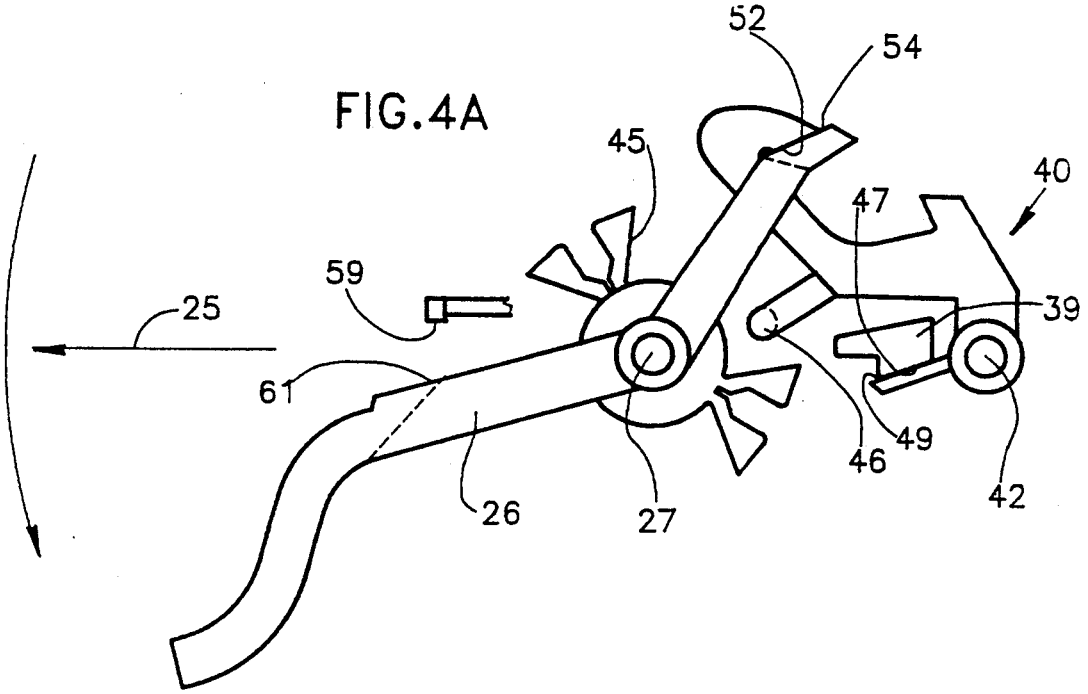
FIGS. 4A and 4B are generalized top view illustrations of the sprinkler of FIGS. 1 and 2 when operating in a reverse direction in respective hammer engagement and non-hammer engagement orientations.
Figure 4B:
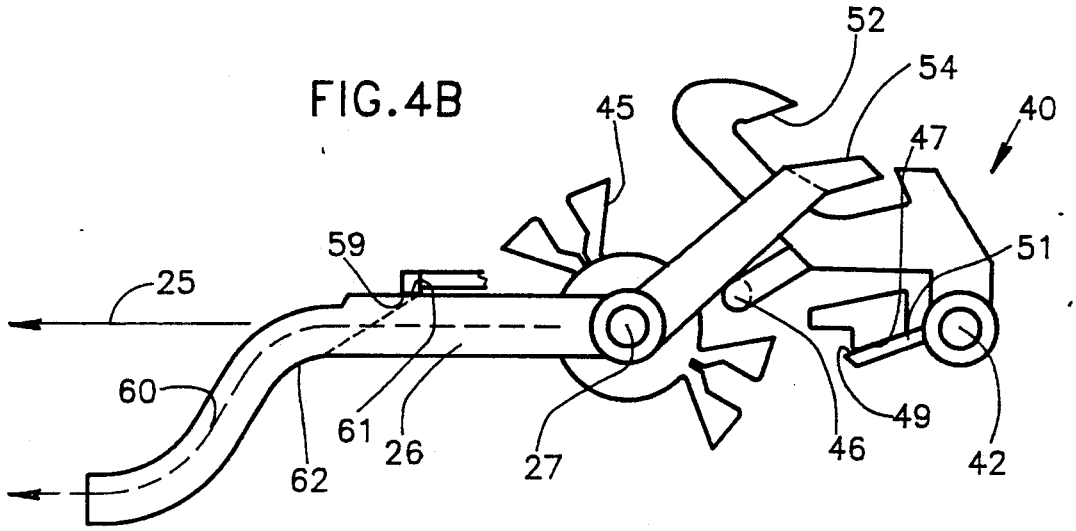

It is seen that the engagement of surfaces 50 and 48 tends to retain apparatus 40 in its first orientation and usually tends to urge apparatus 40 toward its first orientation, which is counterclockwise about the axis defined by pin 42 with respect to the second orientation, illustrated in FIGS. 4A and 4B.

FIG. 3A illustrates the initial portion of the motion of the hammer and deflector element 26, when liquid passes along a curved path 60 defined by the deflector portion of element 26. Passage of liquid through path 60 causes element 26 to rotate counterclockwise about axis 27 until it reaches an extreme counterclockwise orientation, typically beyond the orientation illustrated in FIG. 3B, at which point spring 28 pulls it back into clockwise motion until it returns to the orientation shown in FIG. 3A and produces a hammer impact between striking surface 61 and engagement surface 59, and/or between striking surface 50 and engagement surface 48, which in turn produces forward, i.e. clockwise, rotation of the body 22 about axis 63. Clockwise, forward, rotation of body 22 about axis 63 and relative to shaft 18, concentric rings 30 and 32 mounted thereon and finger portions thereof 34 continues until finger portion 46 engages a surface 35 of finger portion 34.

Up until this point, the orientation of apparatus 40 was limited in the counterclockwise direction of rotation about axis 42 by a stopping surface 37 formed on a protrusion 39 forming part of body 22. Alternatively, the stopping surface may be located such that it engages apparatus 40 at a different location.

From this point onwards, continued forward motion of the sprinkler body 22 about axis 63 causes rotation of apparatus 40 about axis 42 in a clockwise direction, indicated by an arrow 41. As a result of the engagement of finger 46 with surface 35, hammer impacts between surfaces 48 and 50 no longer cause the apparatus 40 to engage stopping surface 37, as seen in FIG. 3C.

Figure 3D:
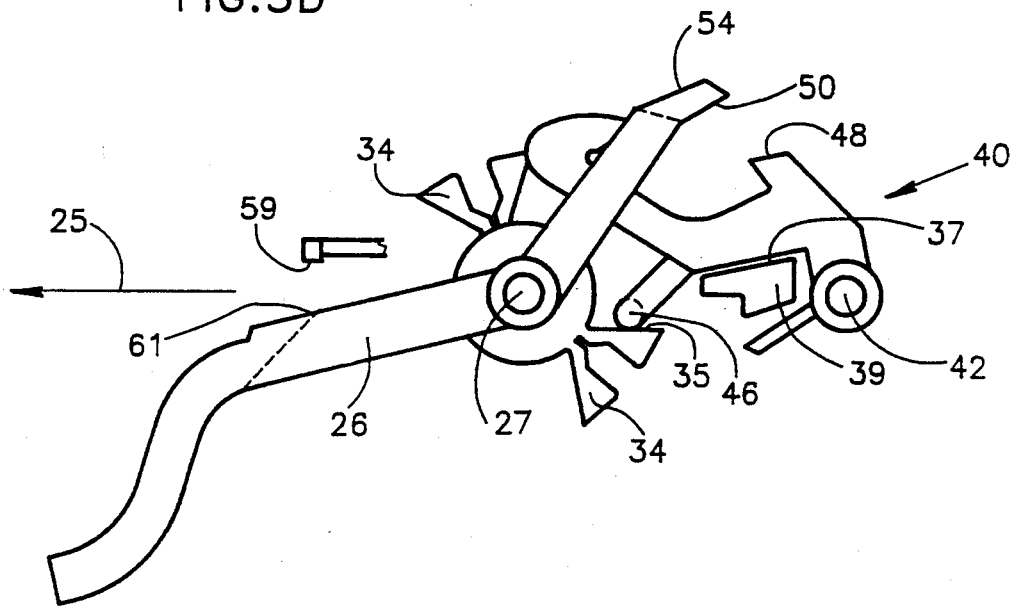
FIGS. 3C, 3D, 3E and 3F are generalized top view illustrations of the sprinkler of FIGS. 1 and 2 at various stages of operation during shifting from operation in a forward direction to operation in a reverse direction.
Figure 3C:
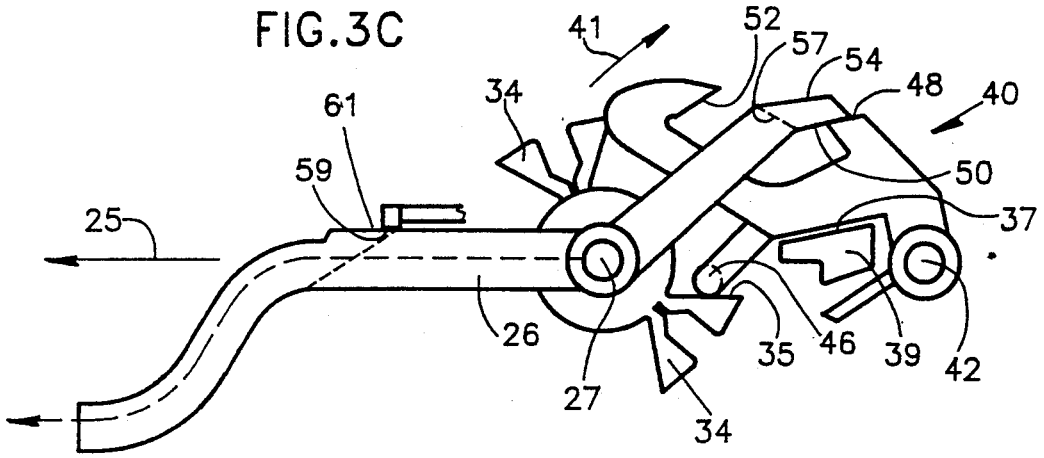

FIG. 3D is similar to FIG. 3C but shows the hammer and deflector element 26 rotated counterclockwise from its orientation shown in FIG. 3C.

Figure 3E:
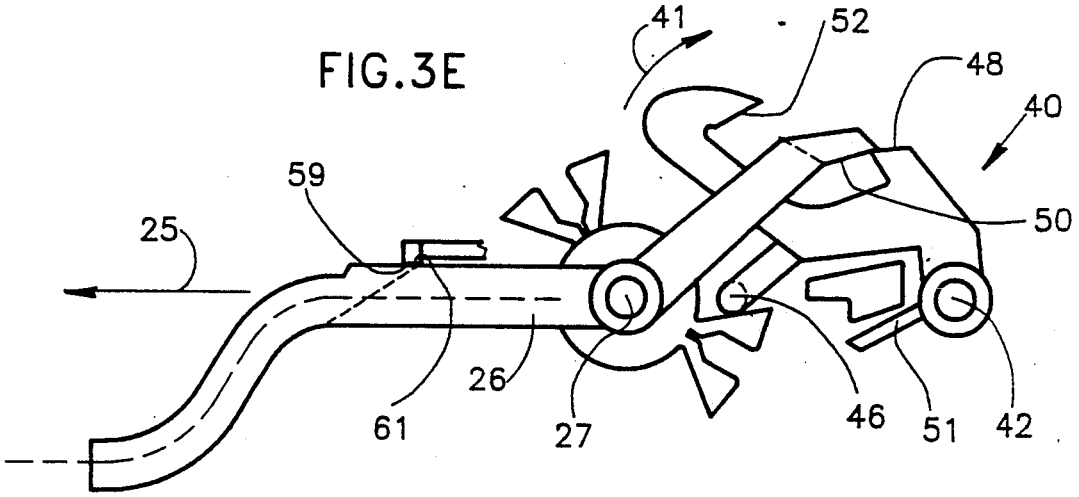

Continued forward motion of the sprinkler body 22 about axis 63 bring the sprinkler into the orientation shown in FIG. 3E. In this orientation, the rotation of apparatus 40 about axis 42 results in surfaces 48 and 50 being primarily offset.

Figure 3F:
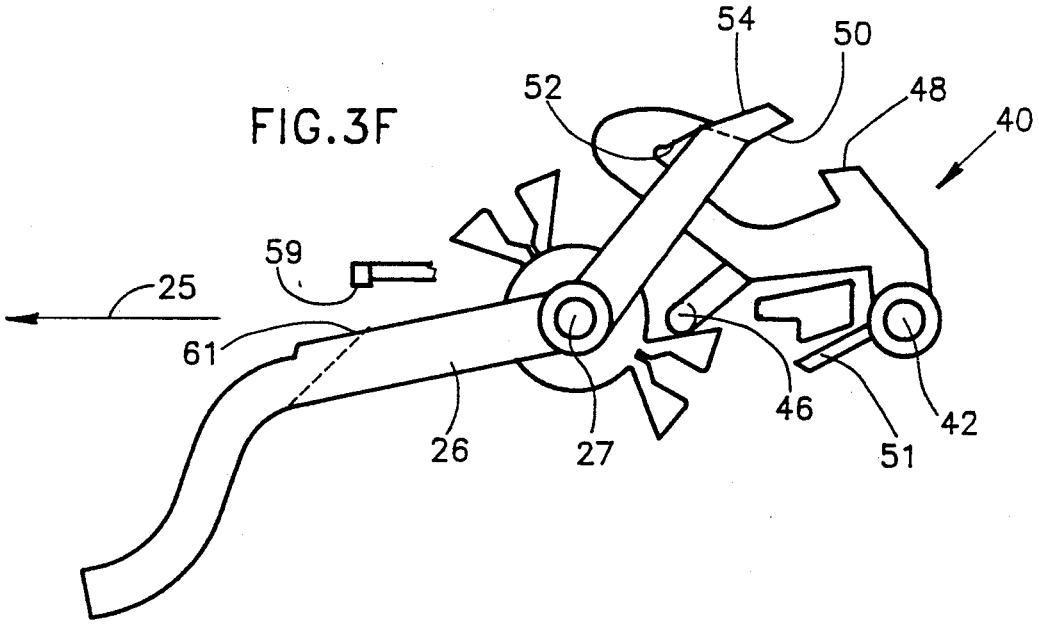

In this situation, as seen in FIG. 3F, rotation of the element 26 in a counterclockwise direction relative to body 22, in response to deflection by the stream of liquid along axis 25, causes part of surface 54 of the hammer to impact against part of surface 52 of apparatus 40.

As a result of the impact between surfaces 52 and 54, the sprinkler shifts to reverse operation as will now be described.

According to an alternative embodiment of the invention, there may exist a stage where neither impact between surfaces 48 and 50 nor impact between surfaces 52 and 54 takes place. This stage, if it occurs, will not continue indefinitely. Normally within a few seconds, the sprinkler will shift to reverse motion.

Referring specifically to FIGS. 4A and 4B, which illustrate reverse motion of the sprinkler, it is noted that when apparatus 40 is in its second orientation, as illustrated, the counterclockwise motion of the hammer and deflector element 26 is limited by apparatus 40, i.e. by engagement of hammer striking surface 54 with engagement surface 52 of apparatus 40, thereby providing a relatively small amplitude of hammer motion in a counter-clockwise sense as seen in FIGS. 4A and 4B in response to deflection by the stream of liquid along axis 25.

This relatively small amplitude motion produces less than relatively full loading of spring 28 and provides counter-clockwise stepped motion of the body 20 in response to engagement of hammer striking surface 54 with engagement surface 52 of apparatus 40.

It is seen that the engagement with surface 52 tends to retain apparatus 40 in its second orientation, which is clockwise about the axis defined by pin 42 with respect to the first orientation, illustrated in FIGS. 3A and 3B.

FIG. 4B illustrates the initial portion of the motion of the hammer and deflector element 26, when liquid passes along a curved path 60 defined by the deflector portion 62 of element 26. Passage of liquid through path 60 causes element 26 to rotate counterclockwise about axis 27 until it reaches an extreme counterclockwise orientation, illustrated in FIG. 4A, at which further counterclockwise motion is prevented by engagement of surfaces 52 and 54 and at which spring 28 urges element 26 back into clockwise motion until it returns to the orientation shown in FIG. 4B. The hammer impact between striking surface 54 and engagement surface 52 produces reverse, i.e. counterclockwise, rotation of the body 22 about axis 63.

Counterclockwise, reverse, rotation of body 22 about axis 63 and relative to shaft 18, concentric rings 30 and 32 mounted thereon and finger portions thereof 34 continues until finger portion 46 engages a surface 45 of finger portion 34.

Up until this point, the orientation of apparatus 40 was limited in the clockwise direction of rotation about axis 42 by a stopping surface 47 formed on protrusion 39, which engages a corresponding contact surface 49 typically formed on a protrusion 51 forming part of apparatus 40. Alternatively, the stopping surface may be located such that it engages apparatus 40 at a different location.

From this point onwards, continued reverse motion of the sprinkler body 22 about axis 63 causes rotation of apparatus 40 about axis 42 in a counterclockwise direction, indicated by an arrow 53. As a result of the engagement of finger 46 with surface 45, hammer impacts between surfaces 52 and 54 no longer cause the apparatus 40 to engage stopping surface 47, as seen in FIG. 4C.

Figure 4D:
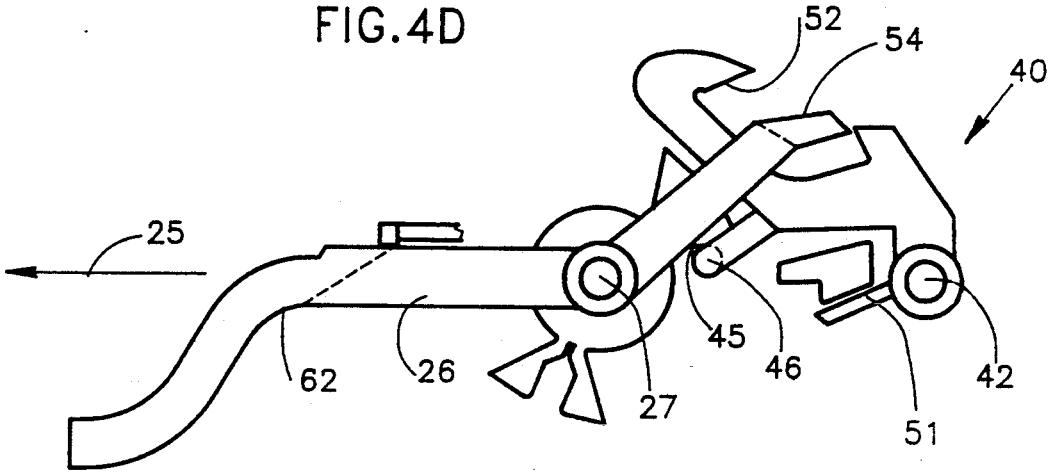
FIGS. 4C, 4D, 4E and 4F are generalized top view illustrations of the sprinkler of FIGS. 1 and 2 at various stages of operation during shifting from operation in a reverse direction to operation in a forward direction.
Figure 4C:
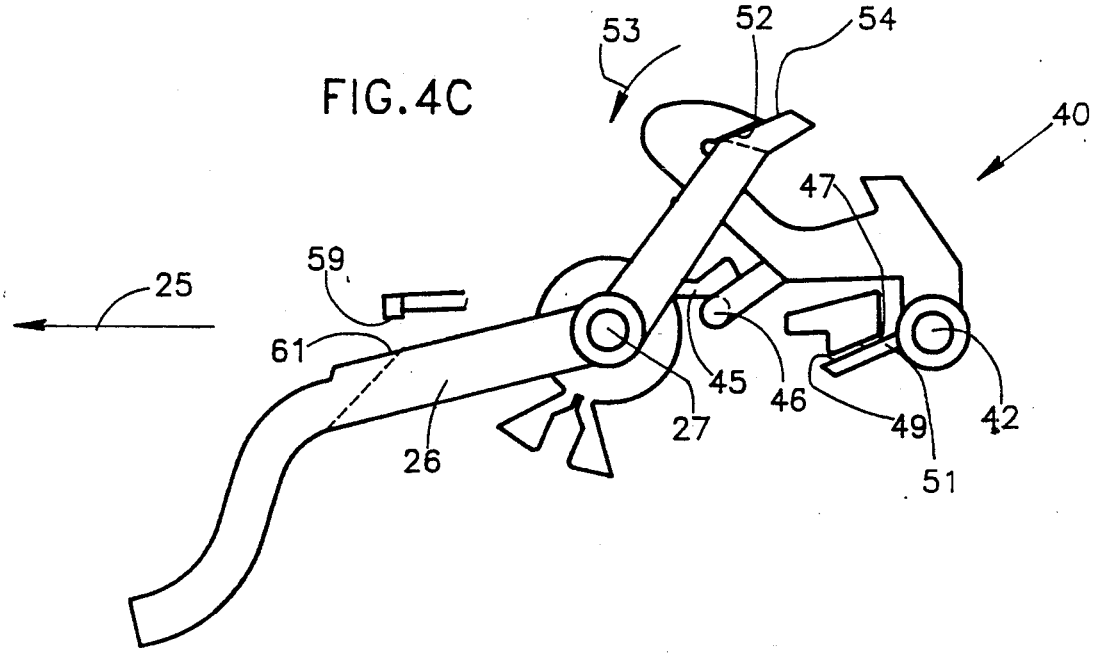

FIG. 4D is similar to FIG. 4C but shows the hammer and deflector element 26 rotated clockwise from its orientation shown in FIG. 4C.

Figure 4E:
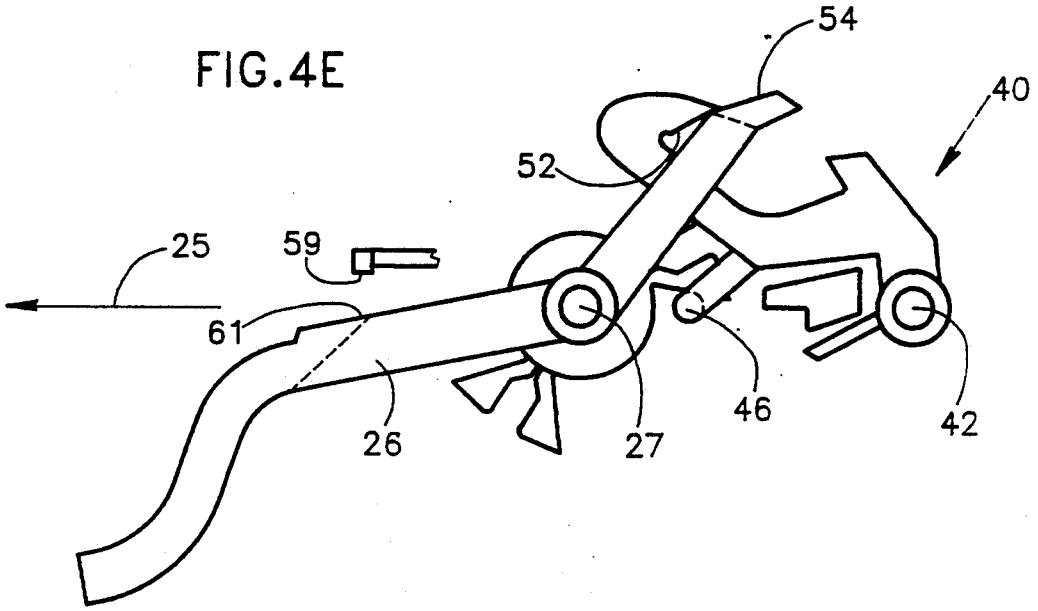

Continued reverse motion of the sprinkler body 22 about axis 63 brings the sprinkler into the orientation shown in FIG. 4E. In this orientation, the rotation of apparatus 40 about axis 42 results in surfaces 52 and 54 being primarily offset.

Figure 4F:
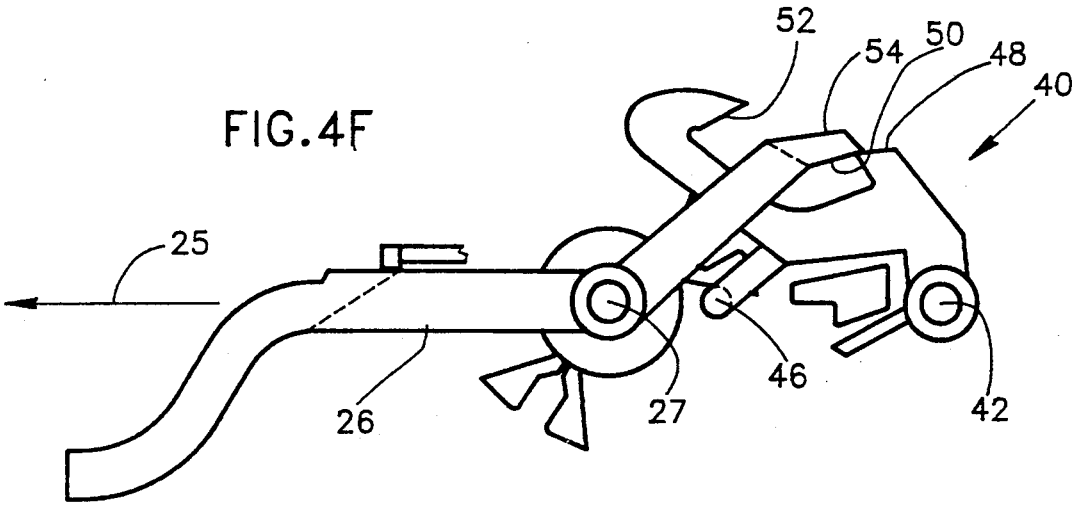

In this situation, as seen in FIG. 4F, rotation of the element 26 in a clockwise direction relative to body 22, as the result of the action of spring 28, causes part of surface 50 of the hammer to impact against part of surface 48 of apparatus 40.

As a result of the impact between surfaces 48 and 50, the sprinkler shifts to forward operation.

According to an alternative embodiment of the invention, there may exist a stage where neither impact between surfaces 48 and 50 nor impact between surfaces 52 and 54 takes place. This stage, if it occurs, will not continue indefinitely. Normally within a few seconds, the sprinkler will shift to normal forward motion.

Figure 5:
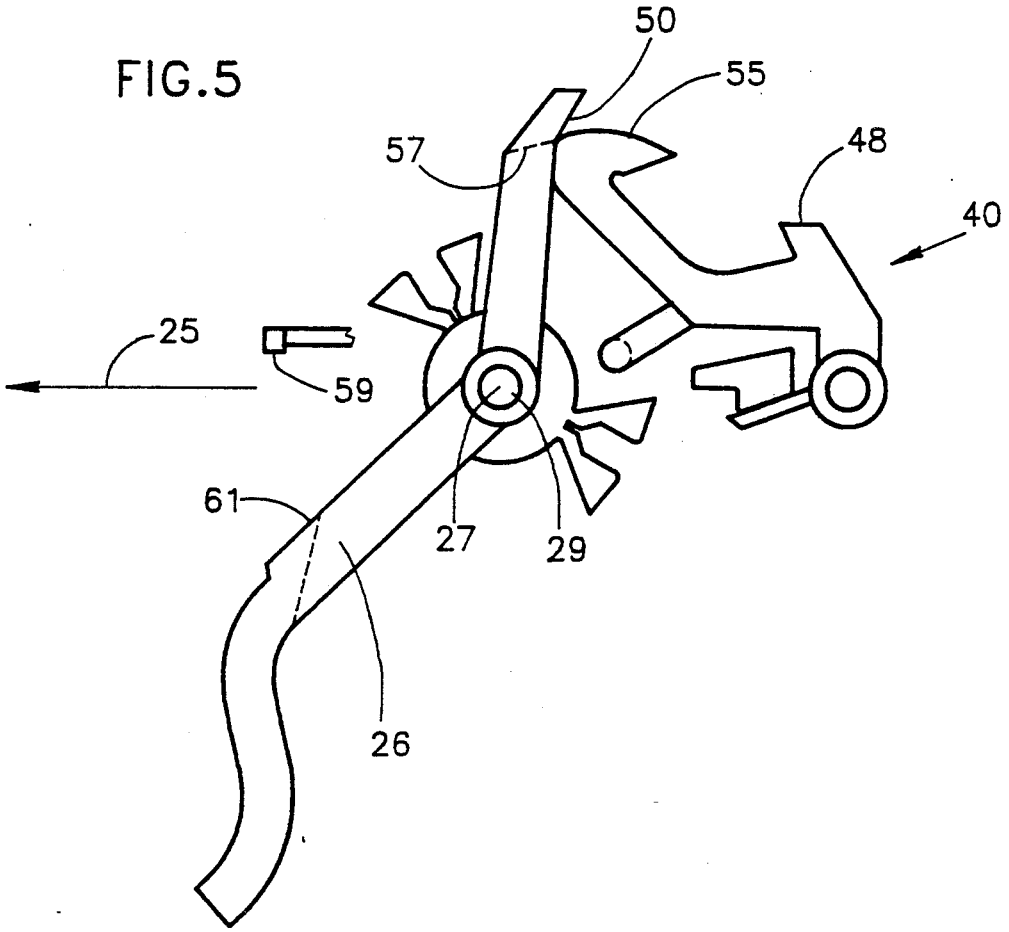
FIG. 5 is a generalized top view illustration of the sprinkler of FIGS. 1 and 2 when operating in a forward direction when the apparatus for selectably limiting the amplitude of rotation lies between its first and second orientations.

Reference is now made to FIG. 5, which illustrates forward motion of the sprinkler, when apparatus 40 lies between the first and second orientations. It is seen that third hammer engagement surface 55 is engaged by either or both of surfaces 50 and 57, thus urging the apparatus 40 back toward its first orientation.

Figure 6:
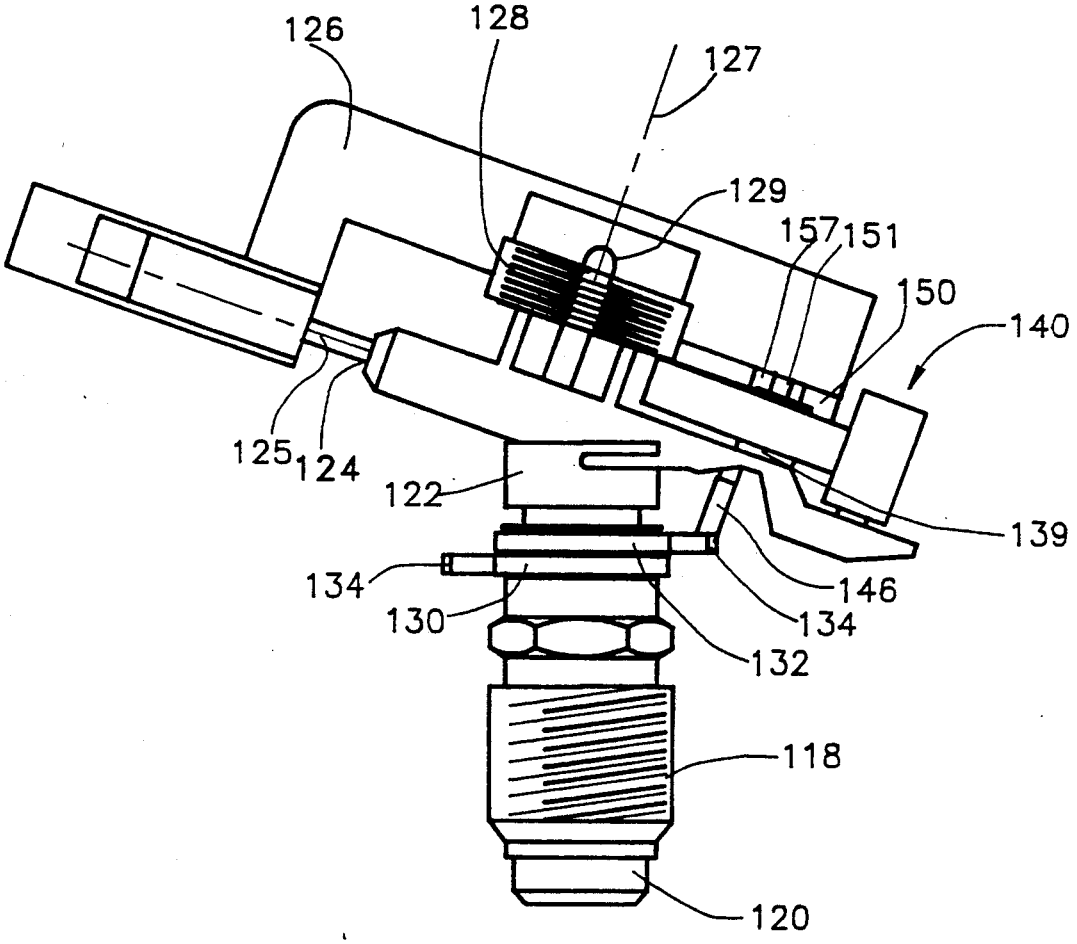
FIG. 6 is a side view illustration of a sprinkler constructed and operative in accordance with a second preferred embodiment of the invention.
Figure 7:
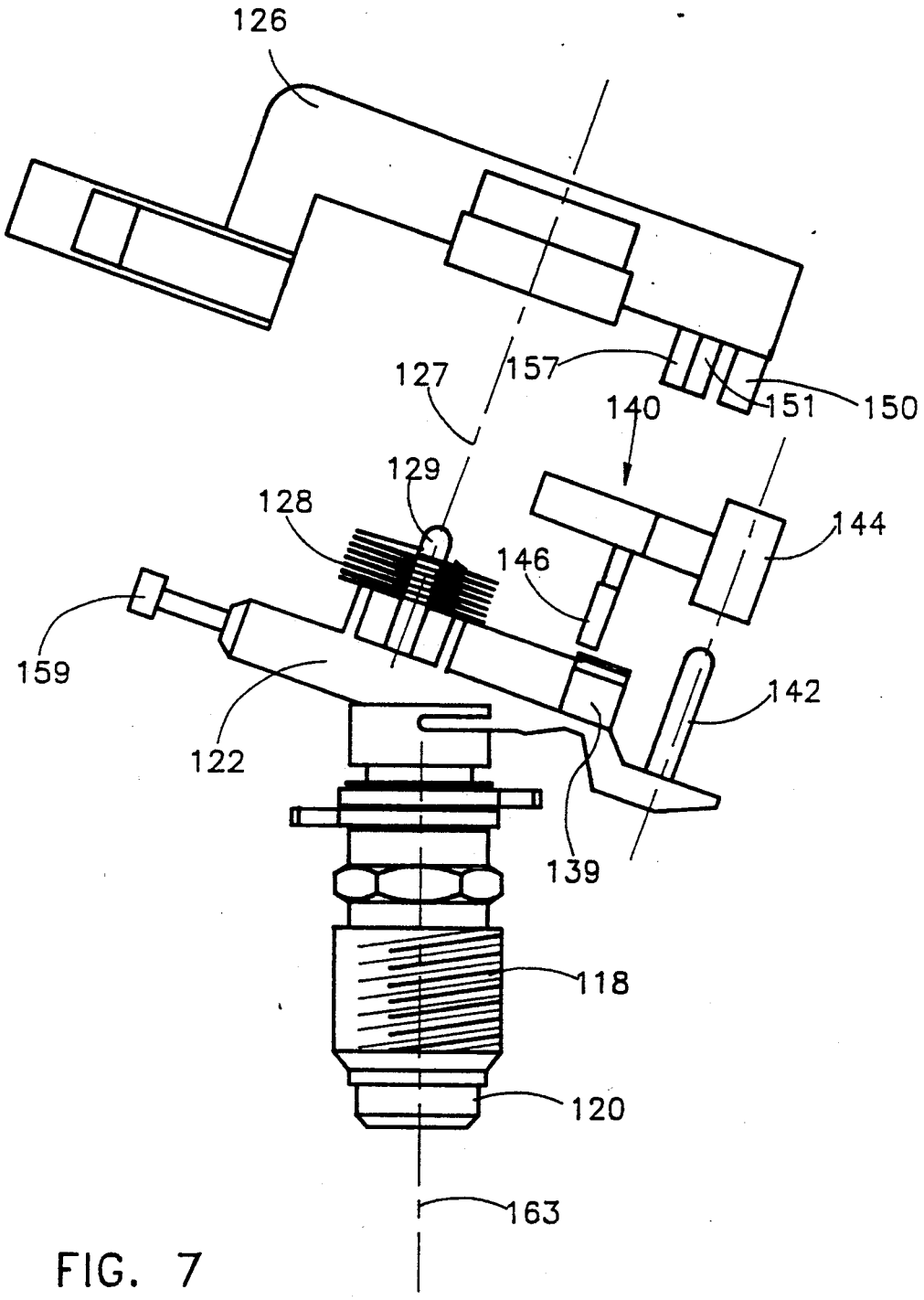
FIG. 7 is a side view illustration in exploded form of the sprinkler of FIG. 6.

Reference is now made to FIGS. 6 and 7, which illustrate a rotary sprinkler constructed and operative in accordance with a further preferred embodiment of the present invention. The rotary sprinkler includes a mounting and liquid coupling shaft 118 that is rotatably mounted and sealingly seated onto a liquid supply stem 120.

Mounted onto stem 120 and preferably integrally formed therewith is a body 122, which defines a nozzle outlet 124 for provision of a pressurized stream of liquid, which is directed generally along a nozzle outlet axis 125. A combination liquid stream deflector and hammer element 126 is rotatably mounted onto body 122 and is spring coupled thereto by a spring 128.

Figure 8B:
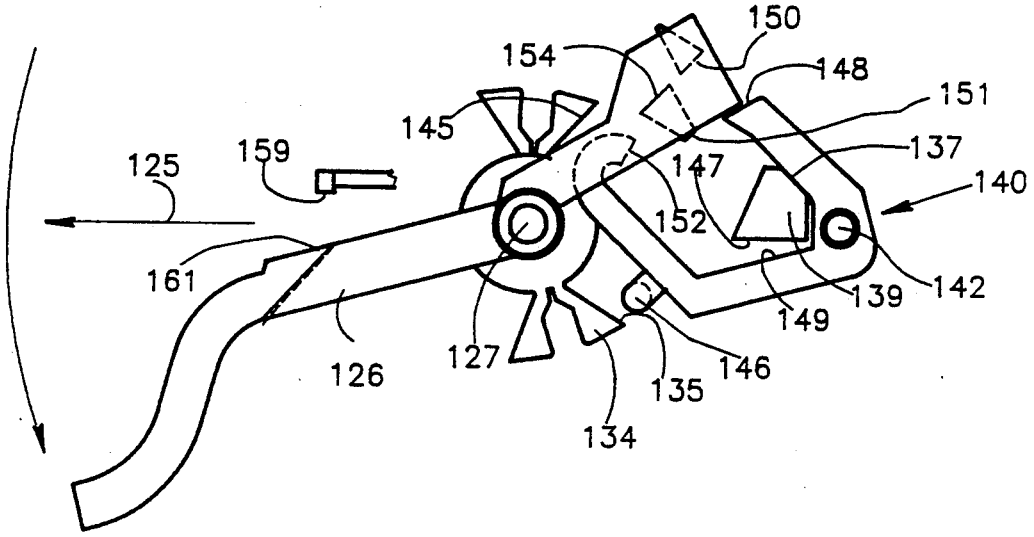
FIGS. 8A and 8B are generalized top view illustrations of the sprinkler of FIGS. 6 and 7 when operating in a forward direction in respective hammer engagement and non-hammer engagement orientations.
Figure 8A:
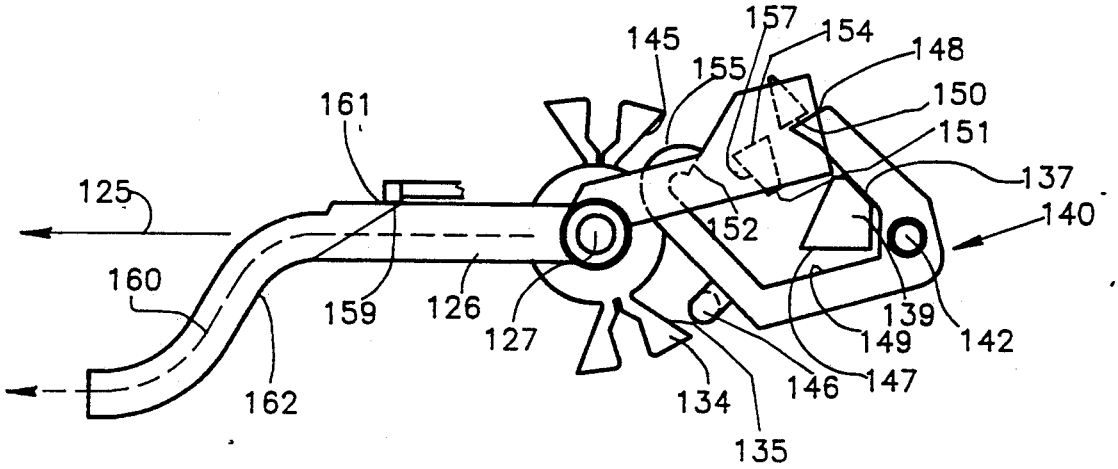

Generally speaking, the action of the deflector and hammer element 126 is intermittently to engage the pressurized stream of liquid for deflection thereof. This causes the deflector to move out of engagement with the stream momentarily, storing potential energy in the spring 128. Spring 128 then exerts a return force that, together with the force produced by engagement of the stream with part of the deflector, causes element 126 to impact against the body, causing its rotation in intermittent steps. What has been described so far is forward motion of the sprinkler, which normally occurs in a clockwise direction when viewed from the top of the sprinkler as shown in FIGS. 8A and 8B.

The sprinkler illustrated in FIGS. 6 and 7 is constructed to provide operation in selectable azimuthal zones. The zones of operation are defined typically by a pair of concentric rings 130 and 132, each formed with protruding end finger portions 134. Rings 130 and 132 are formed with toothed inner peripheral surfaces that selectably engage toothed surfaces (not shown) formed on the shaft 118 so that rings 130 and 132 can be located as desired and retain their location until the location is changed by a user.

The sprinkler of FIGS. 6 and 7 is preferably arranged for forward and backward motion. It is shifted from forward to backward motion by operation of apparatus 140 for selectably limiting the amplitude of motion of the deflector and hammer element 126 and thus determining the direction of rotation of the body.

In accordance with a preferred embodiment of the invention the selectably limiting apparatus 140 has first and second operative orientations corresponding to rotation of the sprinkler in respective forward and return directions. The first operative orientation is illustrated generally in FIGS. 8A and 8B, while the second operative orientation is illustrated generally in FIGS. 9A and 9B.

Apparatus 140 is pivotably mounted onto body 122, typically by means of an upstanding pin 142 integrally formed on body 122, which is engaged by a corresponding collar portion 144, forming part of apparatus 140.

Apparatus 140 is preferably integrally formed as one piece and includes, in addition to collar portion 144, a depending finger portion 146 that serves to engage protruding end finger portions 134 of azimuthal zone selection rings 130 and 132.

Apparatus 140 also defines first hammer engagement surface 148 which is normally engaged by a corresponding hammer striking surface 150 of deflector and hammer element 126 when the sprinkler is rotating in the forward direction. Apparatus 140 also preferably defines a second hammer engagement surface 152, which is engaged by a corresponding hammer striking surface 154 of element 126 when the sprinkler is rotating in the reverse direction.

Additionally in accordance with a preferred embodiment of the present invention, the apparatus for selectably limiting 140 also includes a third hammer engagement surface 155 that may be engaged by a surface 157 of the deflector and hammer element 126 or by surface 151 when the sprinkler is rotating in the forward direction, the third hammer engagement surface 155 being arranged such that the hammer engagement therewith urges the apparatus for selectably limiting 140 toward the first orientation.

According to a preferred embodiment of the invention, the body 122 defines a fourth hammer engagement surface 159 which normally is engaged by a striking surface 161 of the deflector and hammer element 126 during forward motion of the sprinkler. It will be appreciated that when surfaces 159 and 161 engage during forward motion, touching engagement of surfaces 148 and 150 may be eliminated. It is preferred, however, that surfaces 148 and 150 be arranged so that they touch or nearly touch during forward motion, in order to maintain the apparatus 140 in the first orientation. It is preferred that the impact providing forward rotation of the sprinkler body in a clockwise direction be provided by engagement of surfaces 159 and 161.

It is noted that the first hammer engagement surface 148 is configured, located and oriented with respect to the body 122 and with respect to the rotation axis of apparatus 140 defined by pin 142 so that the hammer engagement with surface 148 usually urges the apparatus 140 toward the first orientation and retains the apparatus 140 in the first orientation during multiple hammer engagement producing rotation of the body 122 clockwise about axis 163 and until engagement of depending finger 146 with end finger portions 134 changes the orientation of apparatus 140.

This feature obviates the need, present in the prior art, for the apparatus for selectably limiting the amplitude of motion to include a spring.

Referring specifically to FIGS. 8A and 8B which illustrate forward motion of the sprinkler, it is noted that when apparatus 140 is in its first orientation the counterclockwise motion of the hammer and deflector element 126 is not limited by apparatus 140, thereby providing a relatively large amplitude of hammer motion in a counterclockwise direction, as seen in FIGS. 8A and 8B in response to deflection by the stream of liquid along axis 125. This large amplitude motion produces relatively full loading of spring 128 and thus provides, with the assistance of the force produced by engagement of the liquid stream along axis 125 with a part of the deflector, clockwise stepped motion of the body 120 preferably in response to engagement of the hammer striking surface 161 with engagement surface 159 of body 122.

Figure 9A:
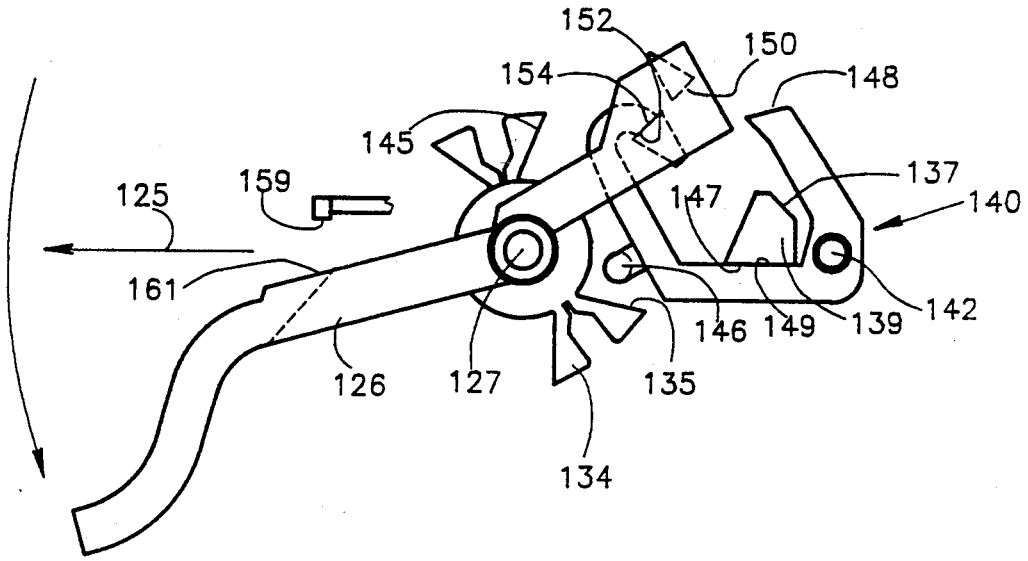
FIGS. 9A and 9B are generalized top view illustrations of the sprinkler of FIGS. 6 and 7 when operating in a reverse direction in respective hammer engagement and non-hammer engagement orientations.
Figure 9B:
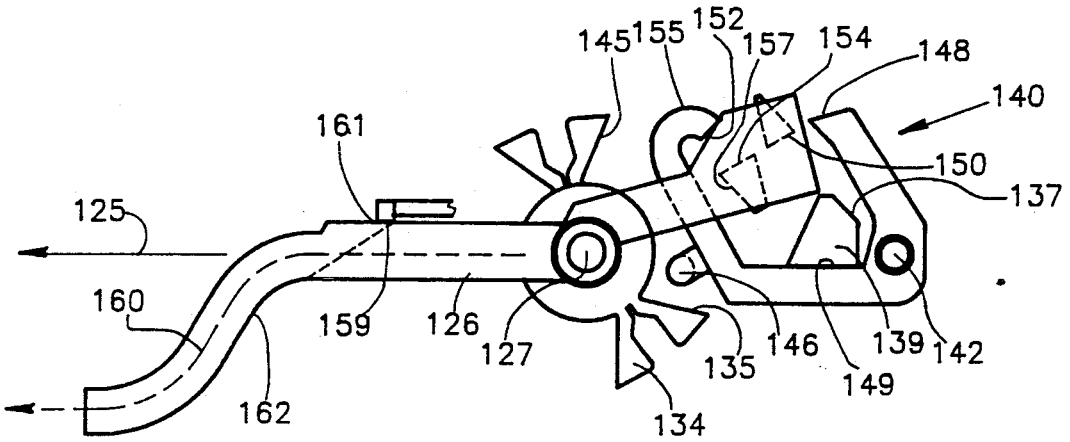

It is seen that the engagement of surfaces 150 and 148 tends to retain apparatus 140 in its first orientation and usually tends to urge apparatus 140 toward its first orientation, which is counterclockwise about the axis defined by pin 142 with respect to the second orientation, illustrated in FIGS. 9A and 9B.

FIG. 8A illustrates the initial portion of the motion of the hammer and deflector element 126, when liquid passes along a curved path 160 defined by the deflector portion of element 126. Passage of liquid through path 160 causes element 126 to rotate counterclockwise about axis 127 until it reaches an extreme counterclockwise orientation, typically beyond the orientation illustrated in FIG. 8B, at which point spring 128 pulls it back into clockwise motion until it returns to the orientation shown in FIG. 8A and produces a hammer impact between striking surface 161 and engagement surface 159, and/or between striking surface 150 and engagement surface 148, which in turn produces forward, i.e. clockwise, rotation of the body 122 about axis 163. Clockwise forward rotation of body 122 about axis 163 and relative to shaft 118, concentric rings 130 and 132 mounted thereon and finger portions thereof 134 continues until finger portion 146 engages a surface 135 of finger portion 134.

Up until this point, the orientation of apparatus 140 was limited in the counterclockwise direction of rotation about axis 142 by a stopping surface 137 formed on a protrusion 139 forming part of body 122. Alternatively, the stopping surface may be located such that it engages apparatus 140 at a different location.

From this point onwards, continued forward motion of the sprinkler body 122 about axis 163 causes rotation of apparatus 140 about axis 142 in a clockwise direction. As a result of the engagement of finger 146 with surface 135, hammer impacts between surfaces 148 and 150 no longer cause the apparatus 140 to engage stopping surface 137.

Continued forward motion of the sprinkler body 122 about axis 163 brings the sprinkler into an orientation in which the rotation of apparatus 140 about axis 142 results in surfaces 148 and 150 being primarily offset. In this situation, rotation of the element 126 in a counterclockwise direction relative to body 122, in response to deflection by the stream of liquid along axis 125, causes part of surface 154 of the hammer to impact against part of surface 152 of apparatus 140.

As a result of the impact between surfaces 152 and 154, the sprinkler shifts to reverse operation as will now be described.

According to an alternative embodiment of the invention, there may exist a stage where neither impact between surfaces 148 and 150 nor impact between surfaces 152 and 154 takes place. This stage, if it occurs, will not continue indefinitely. Normally within a few seconds, the sprinkler will shift to reverse motion.

Referring specifically to FIGS. 9A and 9B, which illustrate reverse motion of the sprinkler, it is noted that when apparatus 140 is in its second orientation, as illustrated, the counterclockwise motion of the hammer and deflector element 126 is limited by apparatus 140, i.e. by engagement of hammer striking surface 154 with engagement surface 152 of apparatus 140, thereby providing a relatively small amplitude of hammer motion in a counter-clockwise sense as seen in FIGS. 9A and 9B in response to deflection by the stream of liquid along axis 125.

This relatively small amplitude motion produces less than relatively full loading of spring 128 and provides counter-clockwise stepped motion of the body 120 in response to engagement of hammer striking surface 154 with engagement surface 152 of apparatus 140.

It is seen that the engagement with surface 152 tends to retain apparatus 140 in its second orientation, which is clockwise about the axis defined by pin 142 with respect to the first orientation, illustrated in FIGS. 8A and 8B.

FIG. 9B illustrates the initial portion of the motion of the hammer and deflector element 126, when liquid passes along a curved path 160 defined by the deflector portion 162 of element 126. Passage of liquid through path 160 causes element 126 to rotate counterclockwise about axis 127 until it reaches an extreme counterclockwise orientation, illustrated in FIG. 9A, at which further counterclockwise motion is prevented by engagement of surfaces 152 and 154 and at which spring 128 urges element 126 back into clockwise motion until it returns to the orientation shown in FIG. 9B. The hammer impact between striking surface 154 and engagement surface 152 produces reverse, i.e. counterclockwise, rotation of the body 122 about axis 163.

Counterclockwise reverse rotation of body 122 about axis 163 and relative to shaft 118, concentric rings 130 and 132 mounted thereon and finger portions thereof 134 continues until finger portion 146 engages a surface 145 of finger portion 134.

Up until this point, the orientation of apparatus 140 was limited in the clockwise direction of rotation about axis 142 by a stopping surface 147 formed on protrusion 139, which engages a corresponding contact surface 149 of apparatus 140. Alternatively, the stopping surface may be located such that it engages apparatus 140 at a different location.

From this point onwards, continued reverse motion of the sprinkler body 122 about axis 163 causes rotation of apparatus 140 about axis 142 in a counterclockwise direction. As a result of the engagement of finger 146 with surface 145, hammer impacts between surfaces 152 and 154 no longer cause the apparatus 140 to engage stopping surface 147.

Continued reverse motion of the sprinkler body 122 about axis 163 brings the sprinkler into an orientation in which the rotation of apparatus 140 about axis 142 results in surfaces 152 and 154 being primarily offset.

In this situation, rotation of the element 126 in a clockwise direction relative to body 122, as the result of the action of spring 128, causes part of surface 150 of the hammer to impact against part of surface 148 of apparatus 140.

As a result of the impact between surfaces 148 and 150, the sprinkler shifts to forward operation.

According to an alternative embodiment of the invention, there may exist a stage where neither impact between surfaces 148 and 150 nor impact between surfaces 152 and 154 takes place. This stage, if it occurs, will not continue indefinitely. Normally within a few seconds, the sprinkler will shift to normal forward motion.

Figure 10:
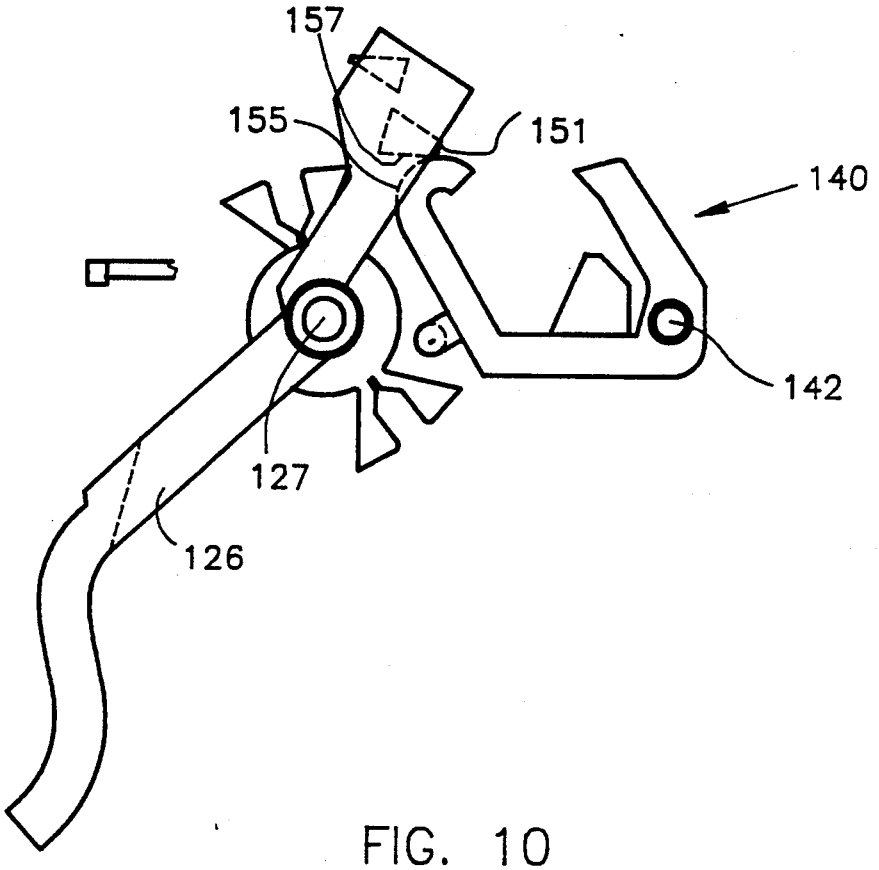
FIG. 10 is a generalized top view illustration of the sprinkler of FIGS. 6 and 7 when operating in a forward direction when the apparatus for selectably limiting the amplitude of rotation lies between its first and second orientations.

Reference is now made to FIG. 10, which illustrates forward motion of the sprinkler, when apparatus 140 lies between the first and second orientations. It is seen that third hammer engagement surface 155 is engaged by either or both of surfaces 151 and 157, thus urging the apparatus 140 back toward its first orientation.

Figure 11:
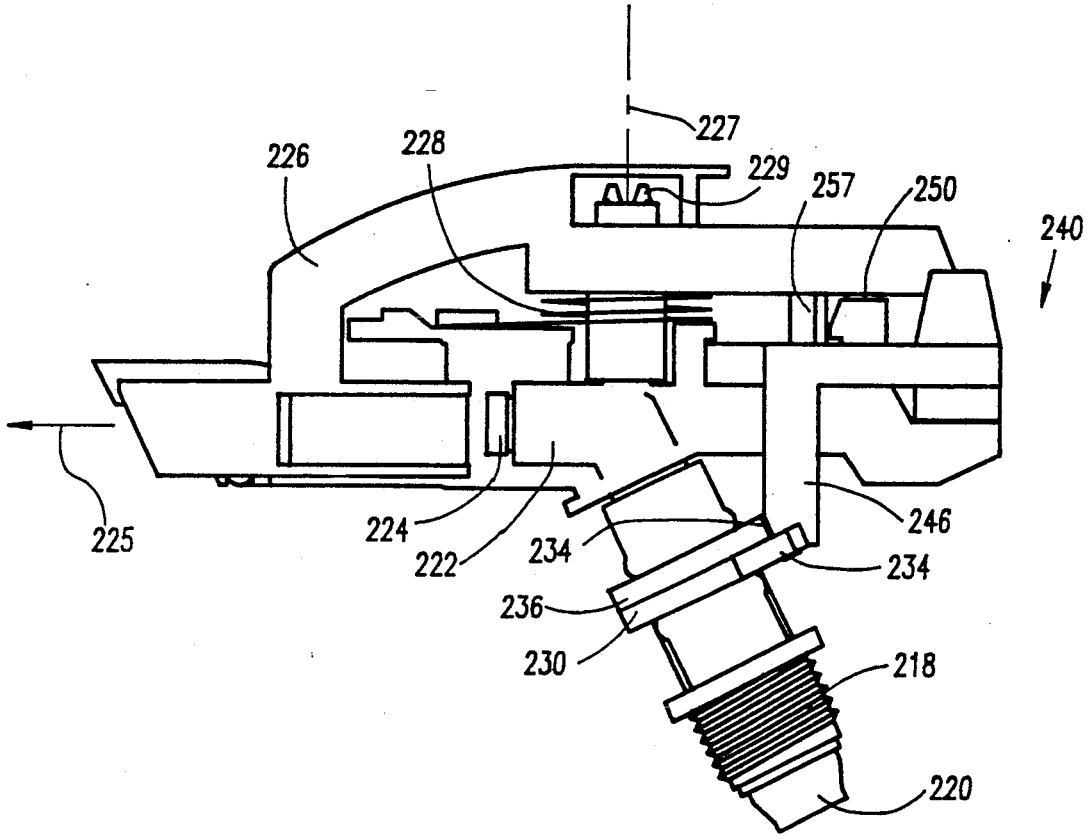
FIG. 11 is another embodiment of the sprinkler illustrated in FIG. 1.
Figure 12:
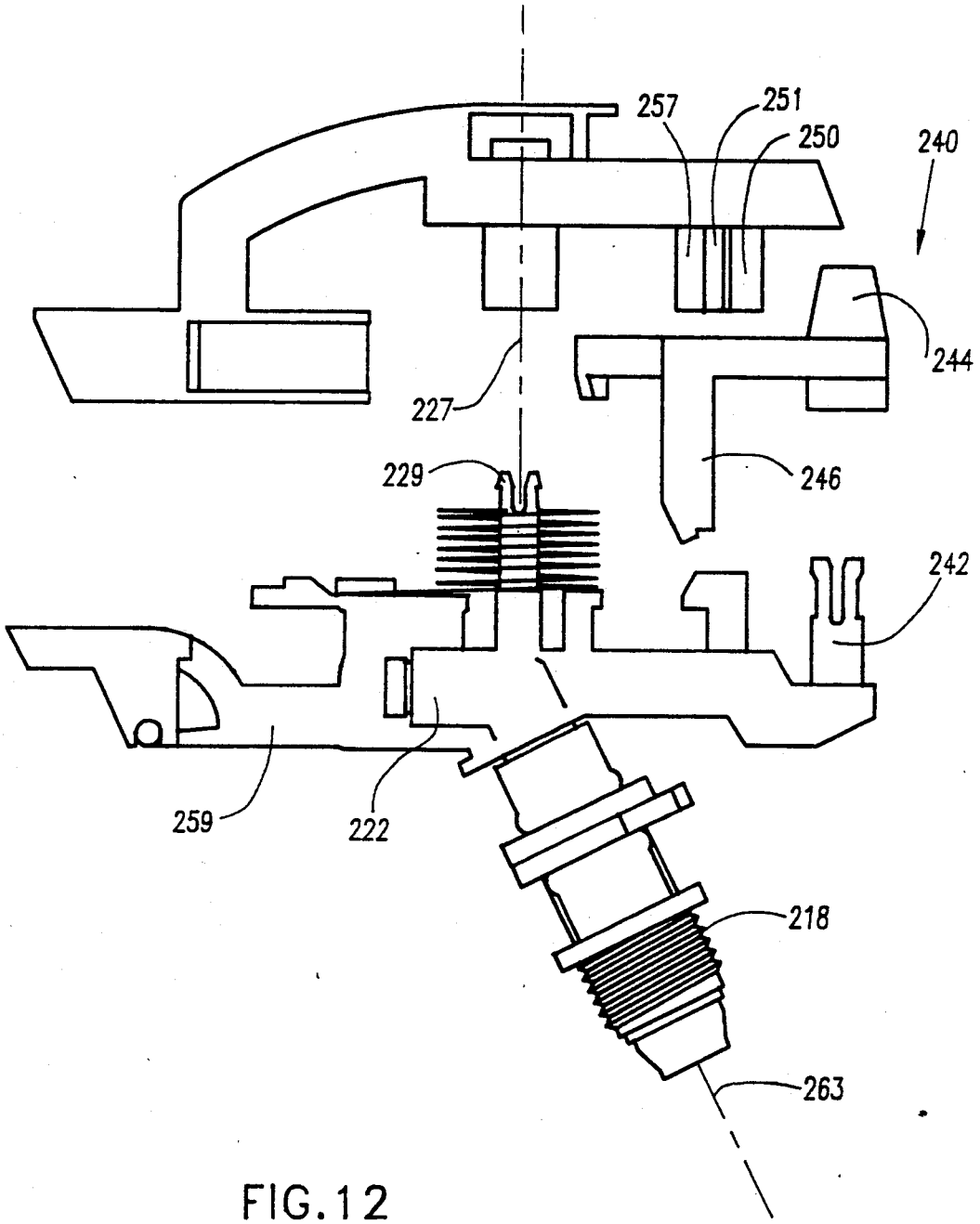
FIG. 12 is a side view illustration in exploded form of the sprinkler in FIG. 11.

Reference is now made to FIGS. 11 and 12, which illustrate a rotary sprinkler constructed and operative in accordance with a more preferred embodiment of the present invention. The rotary sprinkler includes a mounting and liquid coupling shaft 218 that is rotatably mounted and sealingly seated onto a liquid supply stem 220.

Mounted onto stem 220 and preferably integrally formed therewith is a body 222, which defines a nozzle outlet 224 for provision of a pressurized stream of liquid, which is directed generally along a nozzle outlet axis 225. A combination liquid stream deflector and hammer element 226 is rotatably mounted onto body 222 and is spring coupled thereto by a spring 228.

Figure 13A:
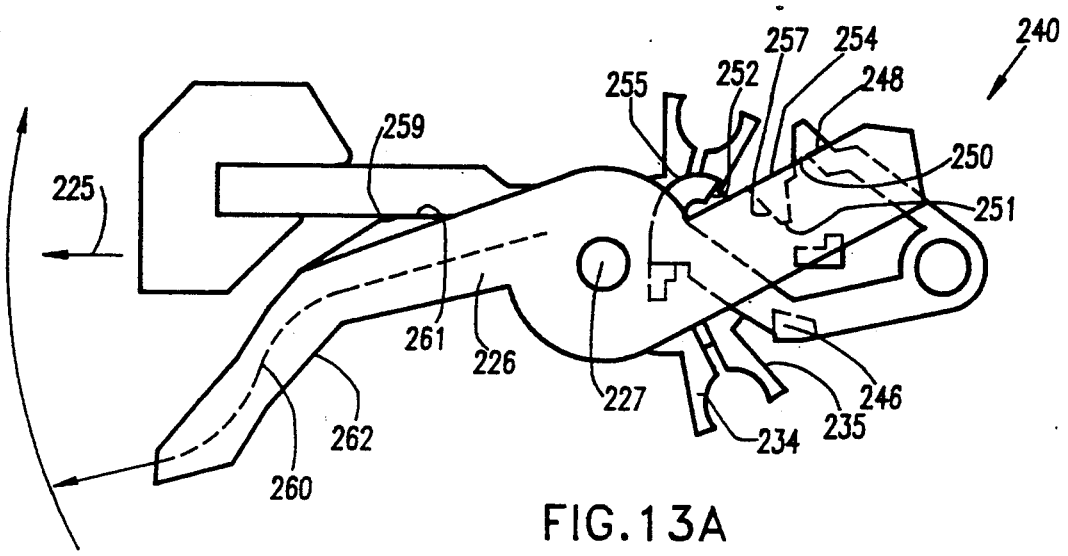
FIGS. 13A and 13B are generalized top view illustrations of the sprinkler of FIGS. 11 and 12 when operating in a forward direction in respective hammer engagement and non-hammer engagement orientations.
Figure 13B:
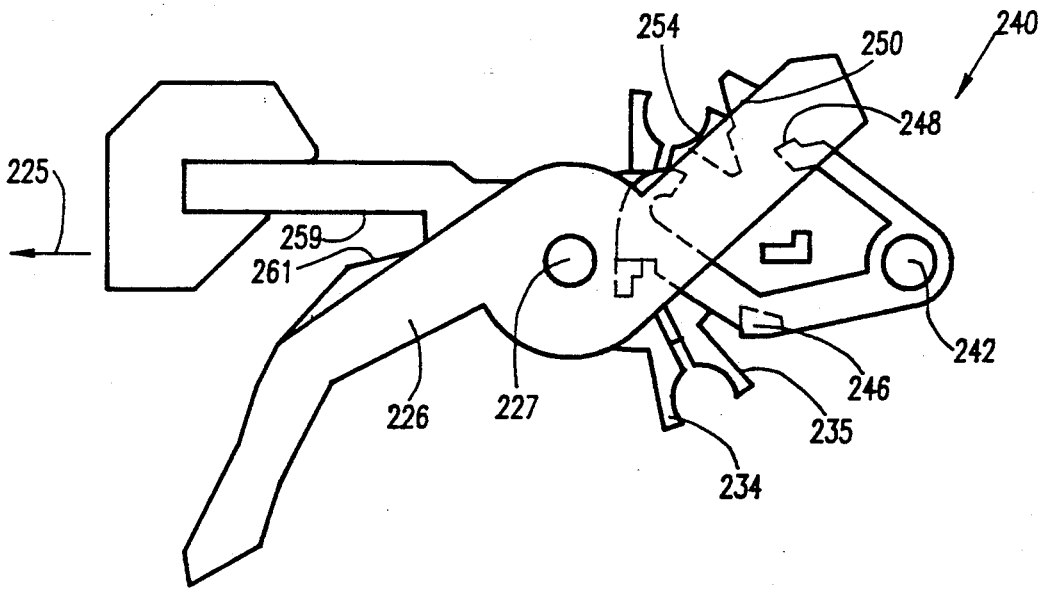

Generally speaking, the action of the deflector and hammer element 226 is intermittently to engage the pressurized stream of liquid for deflection thereof. This causes the deflector to move out of engagement with the stream momentarily, storing potential energy in the spring 228. Spring 228 then exerts a return force that, together with the force produced by engagement of the stream with part of the deflector, causes element 226 to impact against the body, causing its rotation in intermittent steps. What has been described so far is forward motion of the sprinkler, which normally occurs in a clockwise direction when viewed from the top of the sprinkler as shown in FIGS. 13A and 13B.

The sprinkler illustrated in FIGS. 11 and 12 is constructed to provide operation in selectable azimuthal zones. The zones of operation are defined typically by a pair of concentric rings 230 and 236, each formed with protruding end finger portions 234. Rings 230 and 236 are formed with toothed inner peripheral surfaces that selectably engage toothed surfaces (not shown) formed on the shaft 218 so that rings 230 and 236 can be located as desired and retain their location until the location is changed by a user.

The sprinkler of FIGS. 11 and 12 is arranged for forward and backward motion. It is shifted from forward to backward motion by operation of apparatus 240 for selectably limiting the amplitude of motion of the deflector and hammer element 226 and thus determining the direction of rotation of the body.

In accordance with a preferred embodiment of the invention the selectably limiting apparatus 240 has first and second operative orientations corresponding to rotation of the sprinkler in respective forward and return directions. The first operative orientation is illustrated generally in FIGS. 13A and 13B, while the second operative orientation is illustrated generally in FIGS. 14A and 14B.

Apparatus 240 is pivotably mounted onto body 222, typically by means of an upstanding pin 242 integrally formed on body 222, which is engaged by a corresponding collar portion 244, forming part of apparatus 240.

Apparatus 240 is preferably integrally formed as one piece and includes, in addition to collar portion 244, a depending finger portion 246 that serves to engage protruding end finger portions 234 of azimuthal zone selection rings 230 and 236.

Apparatus 240 also defines first hammer engagement surface 248 which is normally engaged by a corresponding hammer striking surface 250 of deflector and hammer element 226 when the sprinkler is rotating in the forward direction. Apparatus 240 also preferably defines a second hammer engagement surface 252, which is engaged by a corresponding hammer striking surface 254 of element 226 when the sprinkler is rotating in the reverse direction.

Additionally in accordance with a preferred embodiment of the present invention, the apparatus for selectably limiting 240 also includes a third hammer engagement surface 255 that may be engaged by either or both of surfaces 251 and 257 of the deflector and hammer element 226 when the sprinkler is rotating in the forward direction, the third hammer engagement surface 255 being arranged such that the hammer engagement therewith urges the apparatus for selectably limiting 240 toward the first orientation.

According to a preferred embodiment of the invention, the body 222 defines a fourth hammer engagement surface 259 which normally is engaged by a striking surface 261 of the deflector and hammer element 226 during forward motion of the sprinkler. It will be appreciated that when surfaces 259 and 261 engage during forward motion, touching engagement of surfaces 248 and 250 may be eliminated. It is preferred, however, that surfaces 248 and 250 be arranged so that they touch or nearly touch during forward motion, in order to maintain the apparatus 240 in the first orientation. It is preferred that the impact providing forward rotation of the sprinkler body in a clockwise direction be provided by engagement of surfaces 259 and 261.

It is appreciated that the arm of apparatus 240 which terminates in surface 248 may be made such that it tends to bend slightly in response to impact against surface 250 so as to absorb unwanted shocks and vibrations in the sprinkler during operation thereof.

It is noted that the first hammer engagement surface 248 is configured, located and oriented with respect to the body 222 and with respect to the rotation axis of apparatus 240 defined by pin 242 so that the hammer engagement with surface 248 usually urges the apparatus 240 toward the first orientation and retains the apparatus 240 in the first orientation during multiple hammer engagements producing rotation of the body 222 clockwise about axis 263 and until engagement of depending finger 246 with end finger portions 234 changes the orientation of apparatus 240.

This feature obviates the need, present in the prior art, for the apparatus for selectably limiting the amplitude of motion to include a spring.

Referring specifically to FIGS. 13A and 13B which illustrate forward motion of the sprinkler, it is noted that when apparatus 240 is in its first orientation the counterclockwise motion of the hammer and deflector element 226 is not limited by apparatus 240, thereby providing a relatively large amplitude of hammer motion in a counterclockwise direction, as seen in FIGS. 13A and 13B in response to deflection by the stream of liquid along axis 225. This large amplitude motion produces relatively full loading of spring 228 and thus provides, with the assistance of the force produced by engagement of the liquid stream along axis 225 with a part of the deflector, clockwise stepped motion of the body 220 preferably in response to engagement of the hammer striking surface 261 with engagement surface 259 of body 222.

Figure 14A:
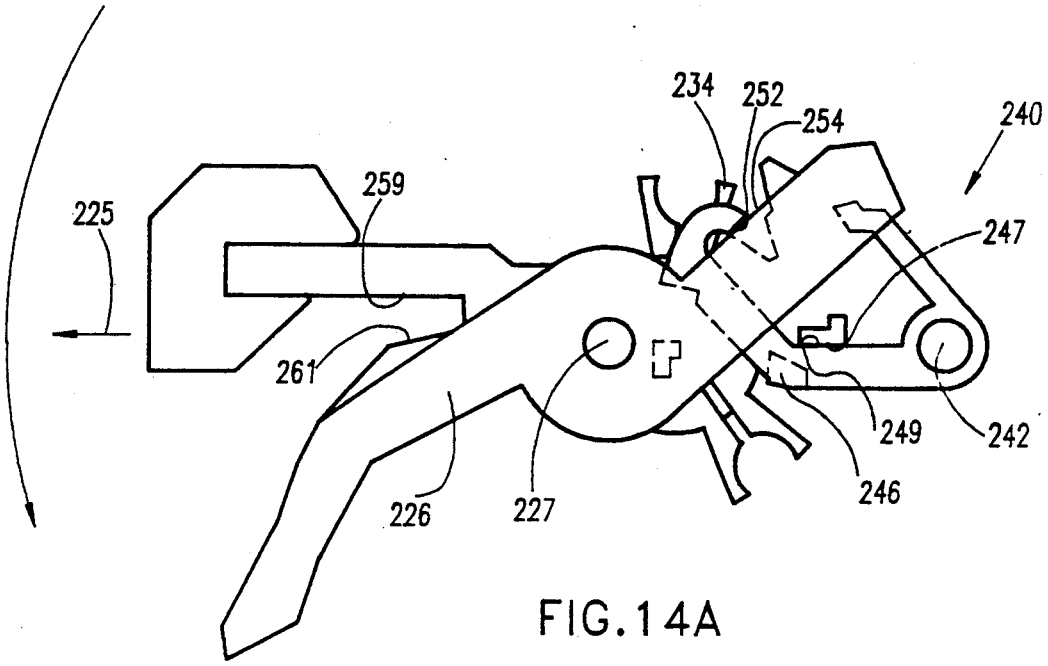
FIGS. 14A and 14B are generalized top view illustrations of the sprinkler of FIGS. 11 and 12 when operating in a reverse direction in respective hammer engagement and nonhammer engagement orientations.
Figure 14B:
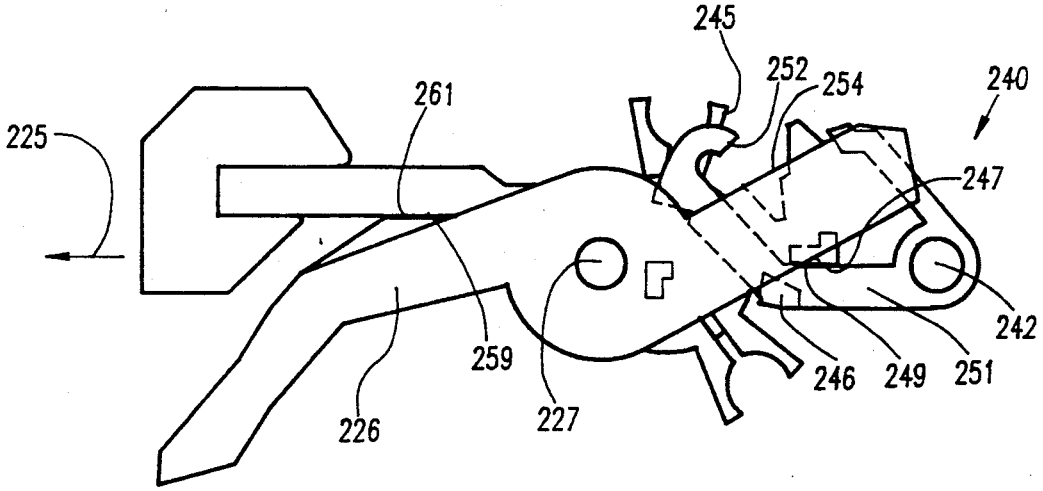

It is seen that the engagement of surfaces 250 and 248 tends to retain apparatus 240 in its first orientation and usually tends to urge apparatus 240 toward its first orientation, which is counterclockwise about the axis defined by pin 242 with respect to the second orientation, illustrated in FIGS. 14A and 14B.

FIG. 13A illustrates the initial portion of the motion of the hammer and deflector element 226, when liquid passes along a curved path 260 defined by the deflector portion of element 226. Passage of liquid through path 260 causes element 226 to rotate counterclockwise about axis 227 until it reaches an extreme counterclockwise orientation, typically beyond the orientation illustrated in FIG. 13B, at which point spring 228 pulls it back into clockwise motion until it returns to the orientation shown in FIG. 13A and produces a hammer impact between striking surface 261 and engagement surface 259, and/or between striking surface 250 and engagement surface 248, which in turn produces forward, i.e. clockwise, rotation of the body 222 about axis 263.

Clockwise, forward, rotation of body 222 about axis 263 and relative to shaft 218, concentric rings 230 and 236 mounted thereon and finger portions thereof 234 continues until finger portion 246 engages a surface 235 of finger portion 234.

Up until this point, the orientation of apparatus 240 was limited in the counterclockwise direction of rotation about axis 242 by a stopping surface 237 formed on body 222. Alternatively, the stopping surface may be located such that it engages apparatus 240 at a different location.

From this point onwards, continued forward motion of the sprinkler body 222 about axis 263 causes rotation of apparatus 240 about axis 242 in a clockwise direction, indicated by an arrow 241. As a result of the engagement of finger 246 with surface 235, hammer impacts between surfaces 248 and 250 no longer cause the apparatus 240 to engage stopping surface 237, as seen in FIG. 13C.

Figure 13C:
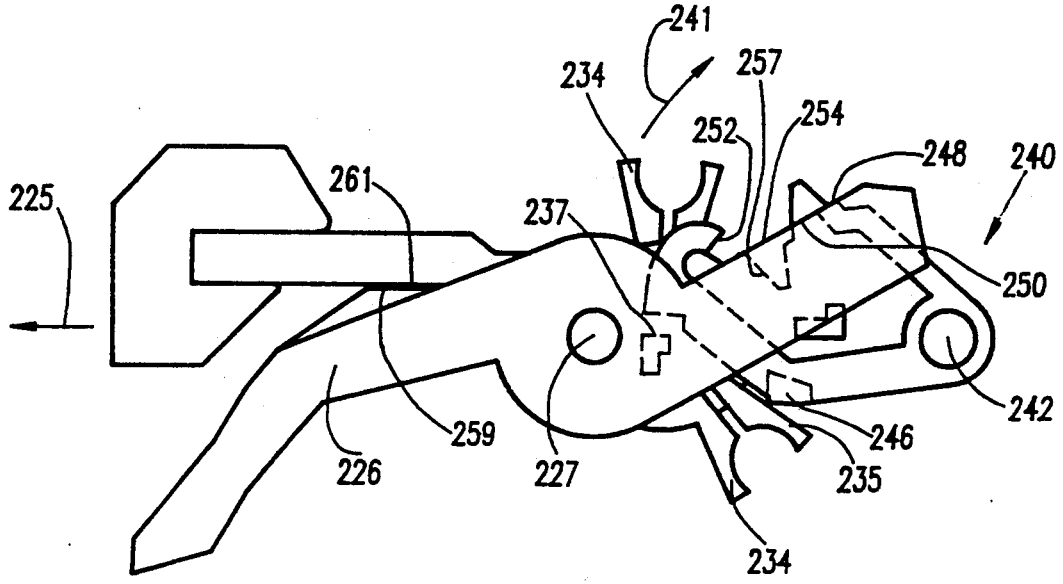
FIGS. 13C, 13D, 13E and 13F are generalized top view illustrations of the sprinkler of FIGS. 11 and 12 at various stages of operation during shifting from operation in a forward direction to operation in a reverse direction.
Figure 13D:
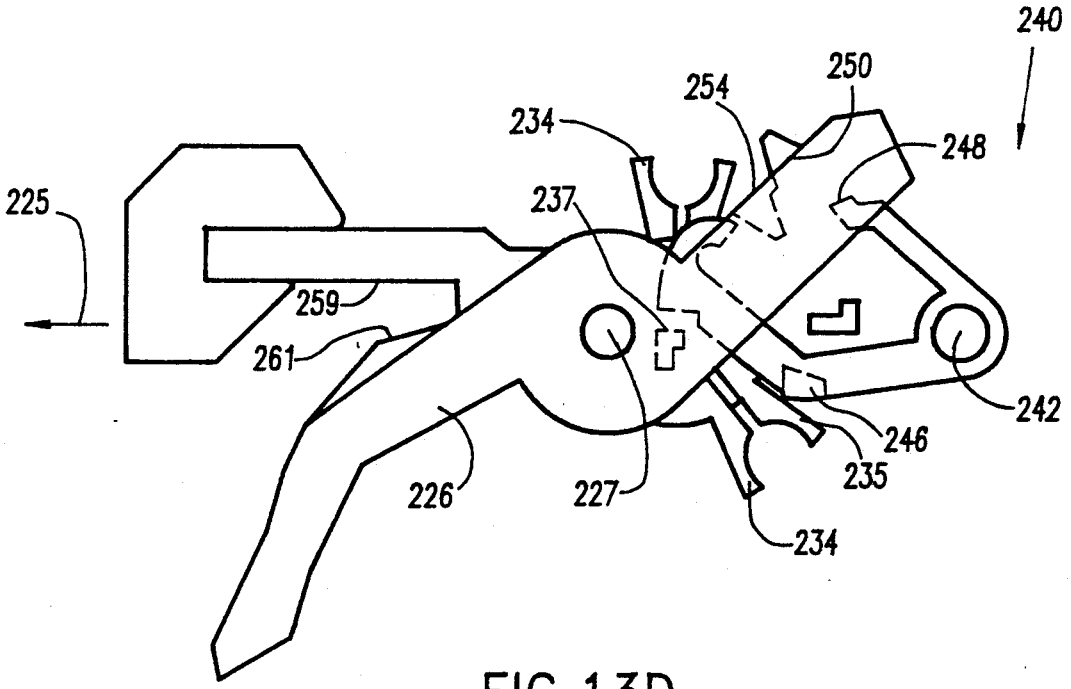

FIG. 13D is similar to FIG. 13C but shows the hammer and deflector element 226 rotated counterclockwise from its orientation shown in FIG. 13C.

Figure 13E:
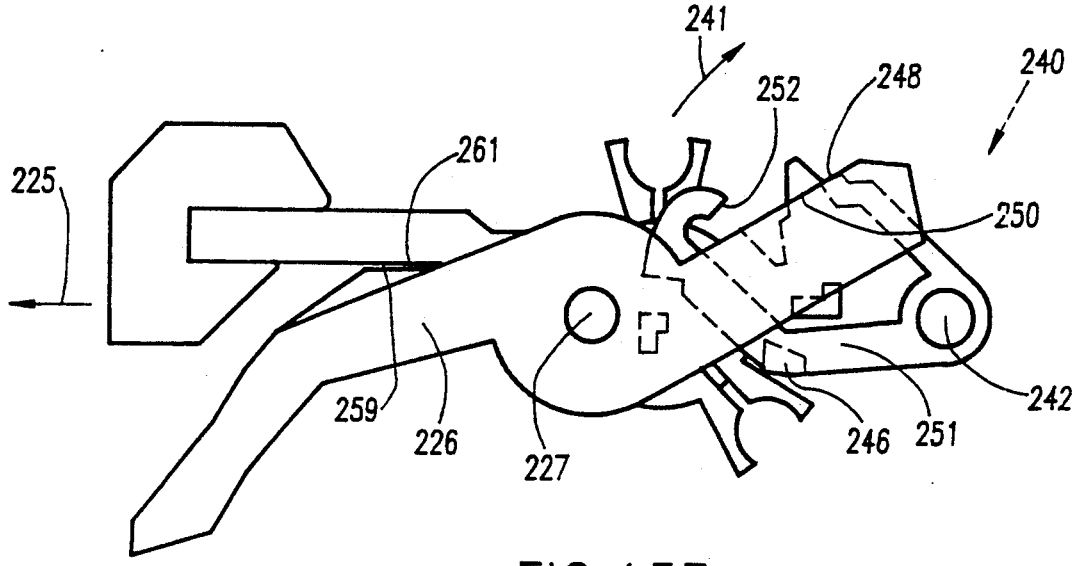

Continued forward motion of the sprinkler body 222 about axis 263 brings the sprinkler into the orientation shown in FIG. 13E. In this orientation, the rotation of apparatus 240 about axis 242 results in surfaces 248 and 250 being primarily offset.

Figure 13F:
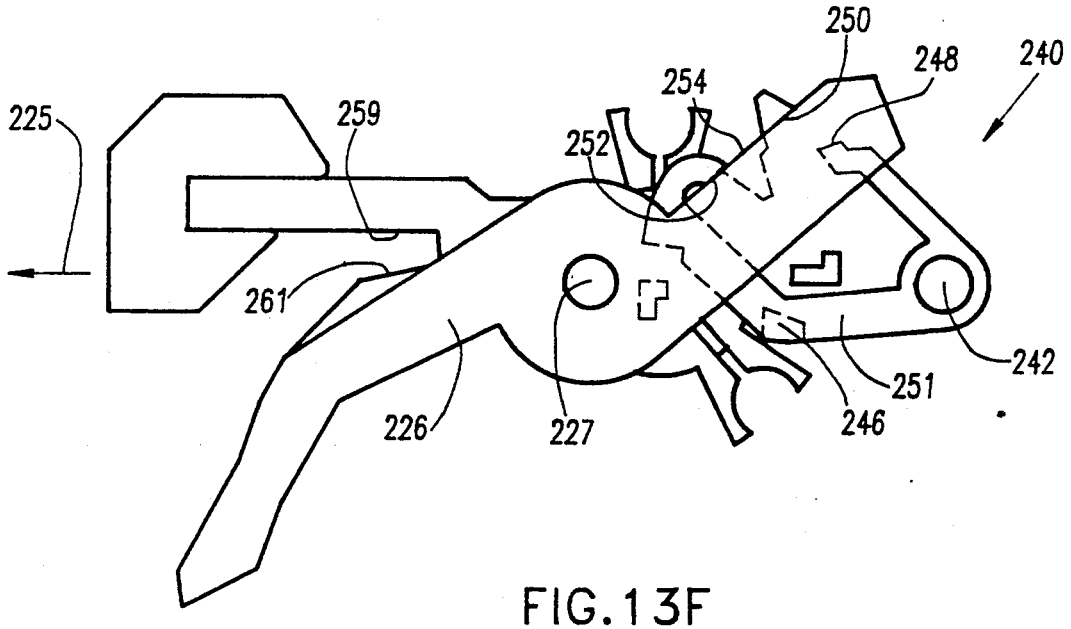

In this situation, as seen in FIG. 13F, rotation of the element 226 in a counterclockwise direction relative to body 222, in response to deflection by the stream of liquid along axis 225, causes part of surface 254 of the hammer to impact against part of surface 252 of apparatus 240.

As a result of the impact between surfaces 252 and 254, the sprinkler shifts to reverse operation as will now be described.

According to an alternative embodiment of the invention, there may exist a stage where neither impact between surfaces 248 and 250 nor impact between surfaces 252 and 254 takes place. This stage, if it occurs, will not continue indefinitely. Normally within a few seconds, the sprinkler will shift to reverse motion.

Referring specifically to FIGS. 14A and 14B, which illustrate reverse motion of the sprinkler, it is noted that when apparatus 240 is in its second orientation, as illustrated, the counterclockwise motion of the hammer and deflector element 226 is limited by apparatus 240, i.e. by engagement of hammer striking surface 254 with engagement surface 252 of apparatus 240, thereby providing a relatively small amplitude of hammer motion in a counter-clockwise sense as seen in FIGS. 14A and 14B in response to deflection by the stream of liquid.

This relatively small amplitude motion produces less than relatively full loading of spring 228 and provides counterclockwise stepped motion of the body 220 in response to engagement of hammer striking surface 254 with engagement surface 252 of apparatus 240.

It is seen that the engagement with surface 252 tends to retain apparatus 240 in its second orientation, which is clockwise about the axis defined by pin 242 with respect to the first orientation, illustrated in FIGS. 13A and 13B.

FIG. 14B illustrates the initial portion of the motion of the hammer and deflector element 226, when liquid passes along a curved path 260 defined by the deflector portion 262 of element 226. Passage of liquid through path 260 causes element 226 to rotate counterclockwise about axis 227 until it reaches an extreme counterclockwise orientation, illustrated in FIG. 14A, at which further counterclockwise motion is prevented by engagement of surfaces 252 and 254 and at which spring 228 urges element 226 back into clockwise motion until it returns to the orientation shown in FIG. 14B. The hammer impact between striking surface 254 and engagement surface 252 produces reverse, i.e. counterclockwise, rotation of the body 222 about axis 263.

Counterclockwise, reverse, rotation of body 222 about axis 263 and relative to shaft 218, concentric rings 230 and 236 mounted thereon and finger portions thereof 234 continues until finger portion 246 engages a surface 245 of finger portion 234.

Up until this point, the orientation of apparatus 240 was limited in the clockwise direction of rotation about axis 242 by a stopping surface 247 formed body 222, which engages a corresponding contact surface 249 typically formed on a protrusion 251 forming part of apparatus 240. Alternatively, the stopping surface may be located such that it engages apparatus 240 at a different location.

From this point onwards, continued reverse motion of the sprinkler body 222 about axis 263 causes rotation of apparatus 240 about axis 242 in a counterclockwise direction, indicated by an arrow 253. As a result of the engagement of finger 246 with surface 245, hammer impacts between surfaces 252 and 254 no longer cause the apparatus 240 to engage stopping surface 247, as seen in FIG. 14C.

Figure 14C:
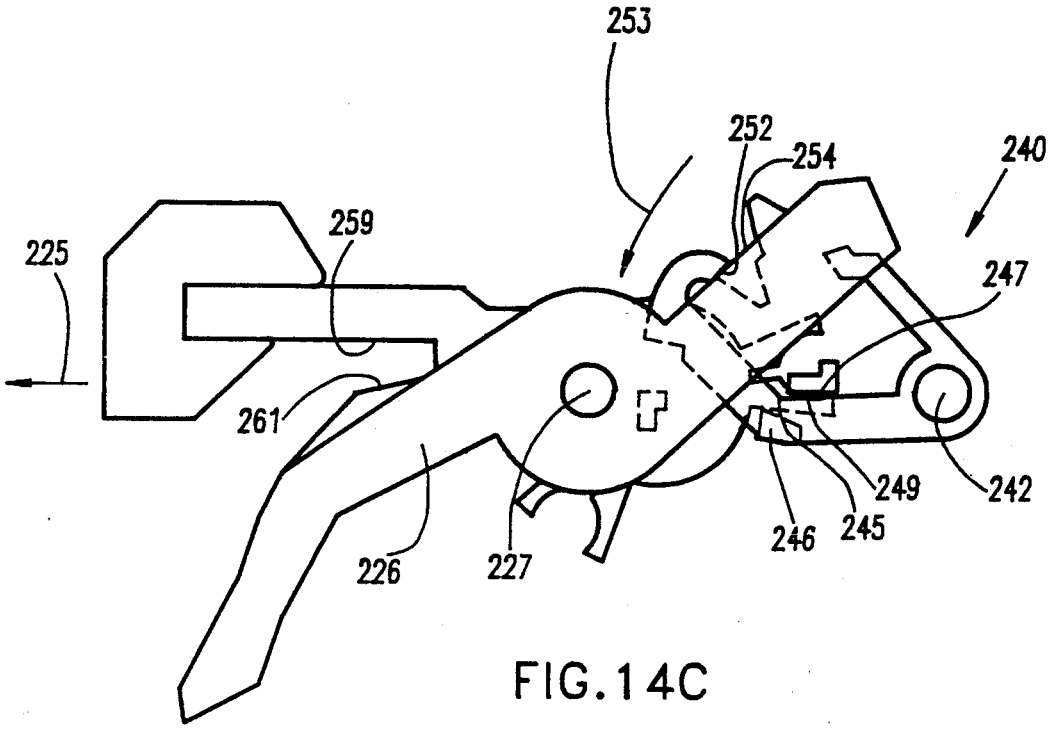
FIGS. 14C, 14D, 14E and 14F are generalized top view illustrations of the sprinkler of FIGS. 11 and 12 at various stages of operation during shifting from operation in a reverse direction to operation in a forward direction.
Figure 14D:
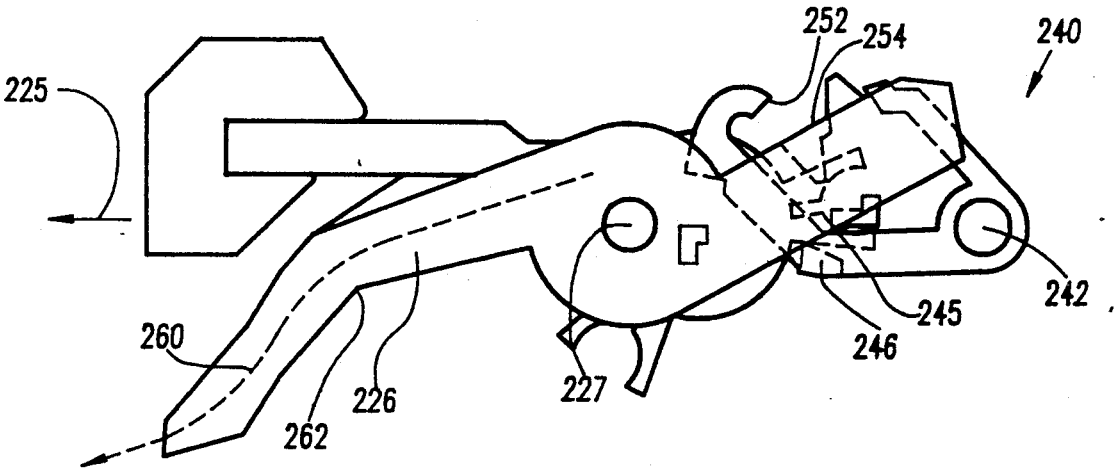

FIG. 14D is similar to FIG. 14C but shows the hammer and deflector element 226 rotated clockwise from its orientation shown in FIG. 14C.

Figure 14E:
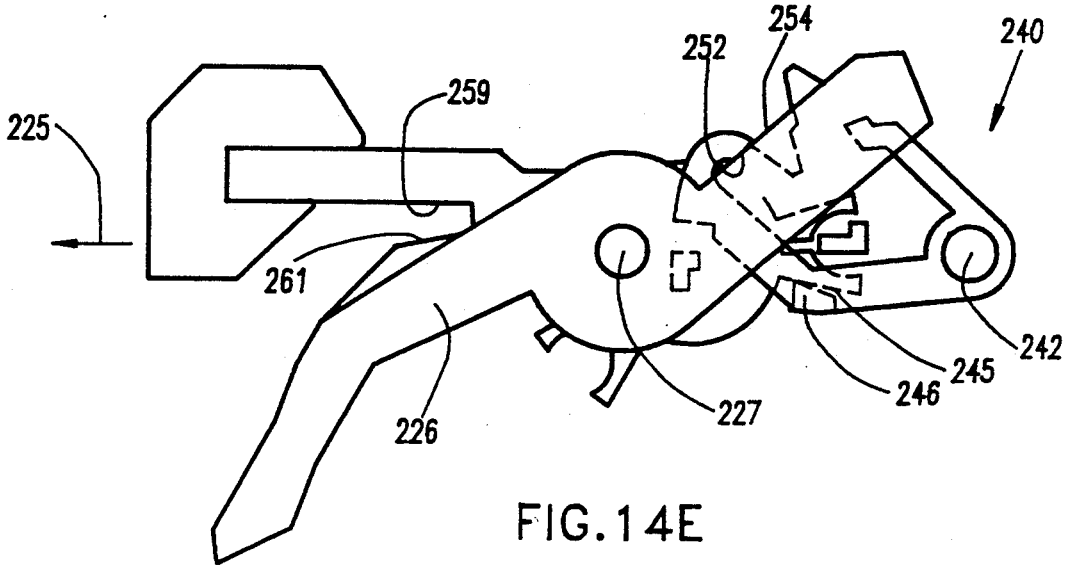

Continued reverse motion of the sprinkler body 222 about axis 263 brings the sprinkler into the orientation shown in FIG. 14E. In this orientation, the rotation of apparatus 240 about axis 242 results in surfaces 252 and 254 being primarily offset.

Figure 14F:
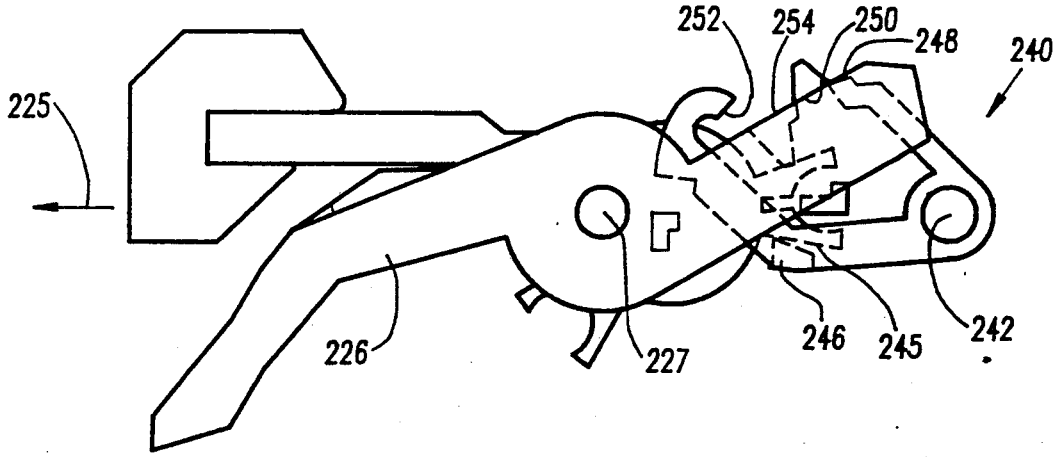

In this situation, as seen in FIG. 14F, rotation of the element 226 in a clockwise direction relative to body 222, as the result of the action of spring 228, causes part of surface 250 of the hammer to impact against part of surface 248 of apparatus 240.

As a result of the impact between surfaces 248 and 250, the sprinkler shifts to forward operation.

According to an alternative embodiment of the invention, there may exist a stage where neither impact between surfaces 248 and 250 nor impact between surfaces 252 and 254 takes place. This stage, if it occurs, will not continue indefinitely. Normally within a few seconds, the sprinkler will shift to normal forward motion.

Figure 15:
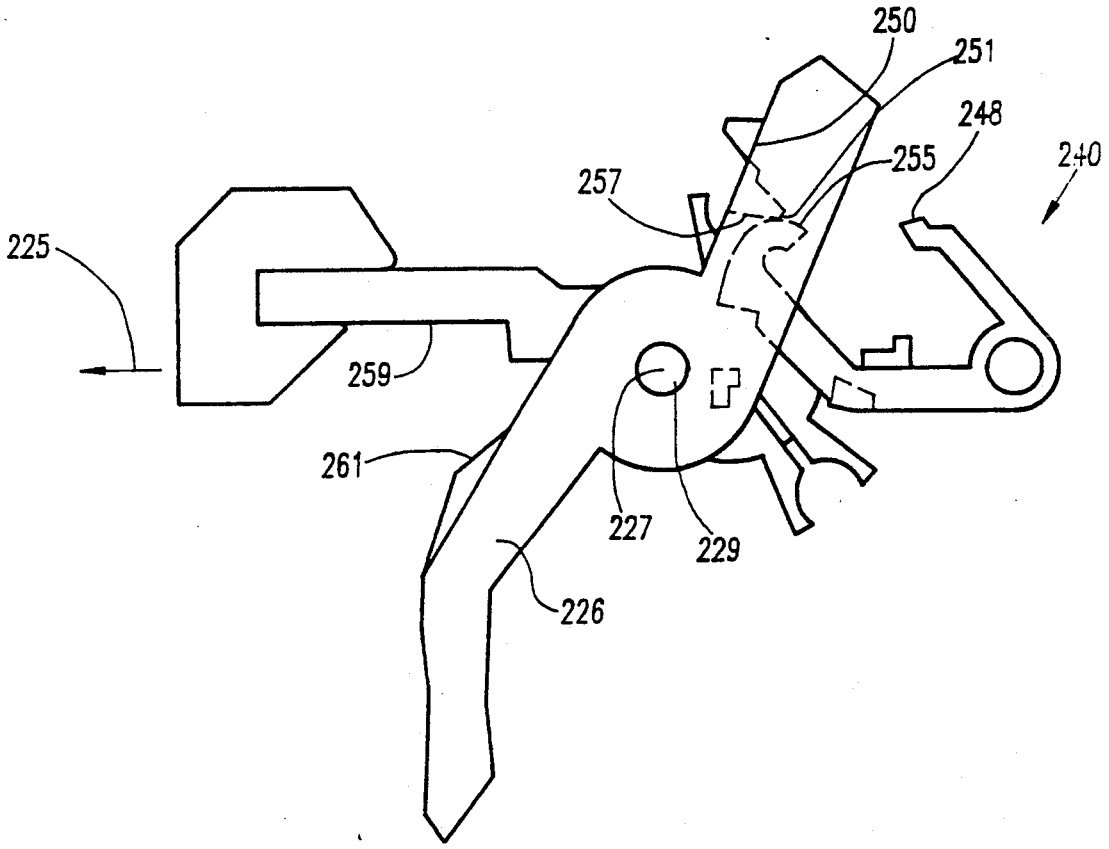
FIG. 15 is a generalized top view illustration of the sprinkler of FIGS. 11 and 12 when operating in a forward direction when the apparatus for selectably limiting the amplitude of rotation lies between its first and second orientations.

Reference is now made to FIG. 15, which illustrates forward motion of the sprinkler, when apparatus 240 lies between the first and second orientations. It is seen that third hammer engagement surface 255 is engaged by either or both of surfaces 251 and 257, thus urging the apparatus 240 back toward its first orientation.

It will be appreciated by persons skilled in the art that the present invention is not limited by what has been particularly shown and described hereinabove. Rather, the scope of the present invention is defined only by the claims which follow:

We claim:

1. An impact drive sprinkler comprising:

a body defining a nozzle arranged to provide a stream of pressurized liquid;

spring loaded stream deflector and hammer means for intermittently engaging the stream and providing in response to the engagement a force causing intermittent rotation of the body about a rotation axis; and means for selectably limiting the amplitude of motion of the deflector and hammer means and thus determining the direction of rotation of the body and the overall range of the resulting spray, the selectably limiting means having first and second orientations corresponding to rotation of the sprinkler in respective forward and return directions and comprising a first hammer engagement surface that is engaged when the sprinkler is rotating in the forward direction, the first hammer engagement surface being arranged such that hammer engagement therewith retains the apparatus for selectably limiting in the first orientation, wherein the amplitude of motion of the deflector and hammer means in the forward direction is not limited by the means for selectably limiting.

2. A sprinkler according to claim 1 and wherein said selectably limiting means also includes a second hammer engagement surface which is engaged when the sprinkler is rotating in the reverse direction, the second hammer engagement surface being arranged such that hammer engagement therewith retains the apparatus for selectably limiting in the second orientation.

3. A sprinkler according to claim 1 and wherein said selectably limiting means also includes a third hammer engagement surface that may be engaged when the sprinkler is rotating in the forward direction, the third hammer engagement surface being arranged such that hammer engagement therewith urges the apparatus for selectably limiting toward the first orientation.

4. A sprinkler according to claim 2 and wherein said selectably limiting means also includes a third hammer engagement surface that may be engaged when the sprinkler is rotating in the forward direction, the third hammer engagement surface being arranged such that hammer engagement therewith urges the apparatus for selectably limiting toward the first orientation.

5. A sprinkler according to claim 1 and wherein said means for selectably limiting the amplitude of motion does not include a spring.

6. A sprinkler according to claim 2 and wherein said means for selectably limiting the amplitude of motion does not include a spring.

7. A sprinkler according to claim 3 and wherein said means for selectably limiting the amplitude of motion does not include a spring.

8. A sprinkler according to claim 1 and wherein said means for selectably limiting is formed as a single piece.

9. A sprinkler according to claim 2 and wherein said means for selectably limiting is formed as a single piece.

10. A sprinkler according to claim 3 and wherein said means for selectably limiting is formed as a single piece.

11. A sprinkler according to claim 4 and wherein said means for selectably limiting is formed as a single piece.

12. A sprinkler according to claim 5 and wherein said means for selectably limiting is formed as a single piece.

13. A sprinkler according to claim 6 and wherein said means for selectably limiting is formed as a single piece.

14. A sprinkler according to claim 1 and wherein said first hammer engagement surface is arranged such that hammer engagement therewith urges the apparatus for selectably limiting to said first orientation.

15. A sprinkler according to claim 2 and wherein said first hammer engagement surface is arranged such that hammer engagement therewith urges the apparatus for selectably limiting to said first orientation.

16. A sprinkler according to claim 3 and wherein said first hammer engagement surface is arranged such that hammer engagement therewith urges the apparatus for selectably limiting to said first orientation.

17. A sprinkler according to claim 4 and wherein said first hammer engagement surface is arranged such that hammer engagement therewith urges the apparatus for selectably limiting to said first orientation.

18. A sprinkler according to claim 1 and wherein during shifting of sprinkler operation from operation in a forward direction to operation in a reverse direction, sequential impacts of said first and second hammer engagement surfaces with corresponding surfaces of said deflection and hammer means occur during a given back and forth rotation cycle of said deflector and hammer means.

19. A sprinkler according to claim 1 and wherein said means for selectably limiting comprises first and second hammer engagement surfaces which are engaged by said first and second striking surfaces during operation of said sprinkler in respective forward and reverse directions, and wherein said first and second striking surfaces and said first and second hammer engagement surfaces are arranged such that upon sequential back and forth rotation of the deflector and hammer means about an axis fixed on said body if said means for selectably limiting is in a predetermined location fixed with respect to said body, said first engagement surface will engage said first striking surface and said second engagement surface will engage said second striking surface.

20. A sprinkler according to claim 2 and wherein said means for selectably limiting comprises first and second hammer engagement surfaces which are engaged by said first and second striking surfaces during operation of said sprinkler in respective forward and reverse directions, and wherein said first and second striking surfaces and said first and second hammer engagement surfaces are arranged such that upon sequential back and forth rotation of the deflector and hammer means about an axis fixed on said body if said means for selectably limiting is in a predetermined location fixed with respect to said body, said first engagement surface will engage said first striking surface and said second engagement surface will engage said second striking surface.

* * * * *